US008853966B2

(12) United States Patent
Naruo et al.

(10) Patent No.: US 8,853,966 B2
(45) Date of Patent: Oct. 7, 2014

(54) LIGHTING DEVICE AND ILLUMINATION APPARATUS INCLUDING SAME

(75) Inventors: Masahiro Naruo, Osaka (JP); Shigeru Ido, Osaka (JP); Sana Esaki, Osaka (JP); Akinori Hiramatu, Nara (JP)

(73) Assignee: Panasonic Corporation, Osaka (JP)

( * ) Notice: Subject to any disclaimer, the term of this patent is extended or adjusted under 35 U.S.C. 154(b) by 142 days.

(21) Appl. No.: 13/529,374

(22) Filed: Jun. 21, 2012

(65) Prior Publication Data

US 2012/0326631 A1 Dec. 27, 2012

(30) Foreign Application Priority Data

Jun. 22, 2011 (JP) ..... 2011-138522
Jun. 22, 2011 (JP) ..... 2011-138527

(51) Int. Cl.
*H05B 37/02* (2006.01)
*H05B 33/08* (2006.01)

(52) U.S. Cl.
CPC ..... *H05B 33/0866* (2013.01); *H05B 37/0245* (2013.01); *H05B 37/02* (2013.01)
USPC ..... 315/297; 315/307; 315/312

(58) Field of Classification Search
CPC ..... H05B 33/0857; H05B 33/0866; H05B 37/02; H05B 37/0245; H05B 39/04; H05B 39/041
USPC ..... 315/291, 297, 307, 308, 312
See application file for complete search history.

(56) References Cited

U.S. PATENT DOCUMENTS

| | | | | |
|---|---|---|---|---|
| 6,498,440 | B2 * | 12/2002 | Stam et al. | 315/291 |
| 2008/0180040 | A1 * | 7/2008 | Prendergast et al. | 315/297 |
| 2008/0238340 | A1 * | 10/2008 | Leung et al. | 315/297 |
| 2010/0194291 | A1 * | 8/2010 | Ishiwata | 315/153 |
| 2010/0225241 | A1 | 9/2010 | Maehara et al. | |
| 2010/0259917 | A1 * | 10/2010 | Ramer et al. | 362/84 |
| 2011/0279015 | A1 * | 11/2011 | Negley et al. | 313/501 |

FOREIGN PATENT DOCUMENTS

JP 2010-176984 8/2010

* cited by examiner

*Primary Examiner* — Tung X Le
(74) *Attorney, Agent, or Firm* — Renner, Otto, Boisselle & Sklar, LLP

(57) ABSTRACT

A lighting device includes lighting control units respectively provided for controlling lighting of solid state light emitting element groups irradiating light of different chromaticities and a color ratio setting unit for setting a target output ratio of the solid state light emitting element groups. In an xy chromaticity diagram of an XYZ color system, a straight line connecting chromaticity coordinates of lights irradiated by a first and a second solid state light emitting element group intersects a black body locus. Further, the lighting control units include a first and a second lighting control unit for controlling lighting of the first and the second solid state light emitting element group, and the first and the second control unit perform a feedback control such that an output ratio of the second to the first solid state light emitting element group becomes equal to the target output ratio thereof.

16 Claims, 18 Drawing Sheets

LIGHTING DEVICE AND ILLUMINATION APPARATUS INCLUDING SAME

FIELD OF THE INVENTION

The present invention relates to a lighting device and an illumination apparatus including same.

BACKGROUND OF THE INVENTION

Conventionally, there is a lighting device including three solid state light emitting element groups irradiating light of different chromaticities (a red color, a green color and a blue color), each having a lighting control unit to control lighting of the corresponding solid state emitting element groups (see, e.g., Japanese Patent Application Publication No. 2010-176984). The lighting device varies a chromaticity of a mixed color light from the light emitting element groups by controlling respective outputs from the three solid state light emitting element groups and controlling an output ratio thereof. Further, there is a lighting device in which an illuminance (output) of a mixed color light and a chromaticity of a light can be varied at the same time to obtain a comfortable illumination light.

In the conventional lighting devices, the lighting control unit includes a drive circuit for supplying a current to the solid state light emitting element group, and a control circuit for controlling the drive circuit. Further, in order that the mixed color light of the lights emitted from the light emitting element groups has a desired chromaticity, it is necessary to control the output ratio of the light emitting element groups to a target output ratio. To that end, each lighting control unit performs a feedback control such that the current being supplied to the solid state light emitting element group becomes a preset target value. Accordingly, the output ratio of the light emitting element groups is equal to the target output ratio, and the mixed color light has the desired chromaticity.

For example, the chromaticities of the lights irradiated by the respective three solid state light emitting element groups have a color coordinate Pr (red), a color coordinate Pg (green), and a color coordinate Pb (blue) in an xy chromaticity diagram of an XYZ color system shown in FIG. 18. In this case, by setting the output ratio of the light emitting element groups to the target output ratio, the chromaticity of the mixed color light can have a color coordinate P0 on the black body locus BL.

As mentioned above, in order that the mixed color light of the lights emitted from the light emitting element groups has a desired chromaticity, it is necessary to make the output ratio of the light emitting element groups equal to the target output ratio. However, it is concerned that the current being supplied to the solid state light emitting element group is deviated from a target value due to, e.g., a difference in parts used in the drive circuit or control circuit. Accordingly, the output of the solid state light emitting element group may be varied and, thus, the output ratio of the light emitting element groups may be deviated from the target output ratio.

For example, if the currents being supplied to the solid state light emitting element groups are deviated from the target values so that a red light increases, a green light decreases, and a blue light increases, for example, the output ratio of the light emitting element groups is significantly deviated from the target output ratio. Thus, the chromaticity of the mixed color light is significantly deviated from the desired chromaticity and, thus, the color reproducibility of the mixed color light is reduced.

In particular, if a deviation duv from the black body locus BL (hereafter simply referred to as deviation duv) is large, the chromaticity of the mixed color light becomes significantly different from the desired chromaticity. The deviation duv is varied depending on a deviation of an output ratio with respect to the target output ratio of two solid state light emitting element groups irradiating a red light and a green light, wherein the black body locus BL is located between the color coordinate Pr of the red light and the color coordinate Pg of the green light.

As shown in FIG. 19, if an output fluctuation has occurred with respect to each of target values due to an increase in the red light, an increase in the green light, and a decrease in the blue light, the mixed color light has a color coordinate P1. Further, if an output fluctuation has occurred with respect to each of the target values due to a decrease in the red light, a decrease in the green light, and an increase in the blue light, the mixed color light has color coordinates P2.

In this manner, if the output fluctuations in the red light and the green light have occurred in the same direction with respect to the target values, the deviation of the output ratio of the red light to the green light from the target output ratio is small. Therefore, in this case, the chromaticity deviation duv of the mixed color light is small, that is, the chromaticity of the mixed color light is not significantly different from the desired chromaticity (a color coordinate P0).

However, if an output fluctuation has occurred with respect to each of the target values due to an increase in the red light, a decrease in the green light, and a decrease in the blue light, the mixed color light has a color coordinate P3. If an output fluctuation has occurred with respect to each of the target values due to an increase in the red light, a decrease in the green light, and an increase in the blue light, the mixed color light has a color coordinate P4. Further, if an output fluctuation has occurred with respect to each of the target values due to a decrease in the red light, an increase in the green light, and an increase in the blue light, the mixed color light has a color coordinate P5. If an output fluctuation has occurred with respect to each of the target values due to a decrease in the red light, an increase in the green light, and a decrease in the blue light, the mixed color light has a color coordinate P6.

In this manner, if output fluctuations in the red light and the green light have occurred in different directions with respect to the target values, the deviation of the output ratio of the red light to the green light from the target output ratio is large. Therefore, in this case, the chromaticity deviation duv of the mixed color light increases, that is, the chromaticity of the mixed color light is significantly different from the desired chromaticity (color coordinate P0).

SUMMARY OF THE INVENTION

In view of the above, the present invention provides a lighting device capable of reducing a deviation from a black body locus and improving a color reproducibility of a mixed color light of the lights irradiated by solid state light emitting element groups and an illumination apparatus including same.

In accordance with a first embodiment of the present invention, there is provided a lighting device including: a plurality of lighting control units configured to control lighting of a plurality of solid state lighting element groups irradiating lights of different chromaticities; and a color ratio setting unit for setting a target output ratio of the solid state light emitting element groups. The lighting control units are provided for the solid state light emitting element groups respectively, and, in an xy chromaticity diagram of an XYZ color system, a straight line connecting chromaticity coordinates of lights irradiated by a first and a second solid state light emitting element group among the solid state light emitting element groups intersects a black body locus. Further, the lighting control units include a first lighting control unit for controlling lighting of the first solid state light emitting element group and a second lighting control unit for controlling lighting of the second solid state light emitting element group. The target output ratio includes a target output ratio of the second to the first solid state light emitting element group, and the first and the second lighting control unit respectively perform feedback controls such that an output ratio of the second to the first solid state light emitting element group becomes equal to the target output ratio of the second to the first solid state light emitting element group.

Further, the first lighting control unit may include a first drive circuit which supplies a power to the first solid state light emitting element group; a first detection unit which detects the power being supplied from the first drive circuit to the first solid state light emitting element group; and a first control circuit which performs a feedback-control on the first drive circuit such that a detection result of the first detection unit becomes equal to a first reference value, and the second lighting control unit may includes a second drive circuit which supplies a power to the second solid state light emitting element group; a second detection unit which detects the power being supplied from the second drive circuit to the second solid state light emitting element group; and a second control circuit which performs a feedback-control on the second drive circuit such that a detection result of the second detection unit becomes equal to a second reference value obtained based on the detection result of the first detection unit.

Further, the lighting device described above may further include an output control unit configured to vary the first reference value Further, the first and the second drive circuit may respectively supply to the first and the second solid state light emitting element group a first and a second intermittent current having a first and a second ON period respectively set based on the target output ratio of the second to the first solid state light emitting element group. The first detection unit may detect an amplitude of the first intermittent current in the first ON period and the second detection unit may detect an amplitude of the second intermittent current in the second ON period. Further, the first control circuit may perform a feedback control such that the amplitude of the first intermittent current becomes equal to the first reference value, and the second control circuit may perform a feedback control such that the amplitude of the second intermittent current becomes equal to the amplitude of the first intermittent current.

Further, the second reference value may be generated by multiplying the target output ratio of the second to the first solid state light emitting element group by the detection result of the first detection unit.

Further, the lighting device described above may further include an error calculating unit which calculates an amplified difference between the detection result of the first detection unit and the first reference value with respect to a total output from the first and the second solid state light emitting element group. Herein, the second reference value may be generated by multiplying a ratio of an output from the second solid state light emitting element group to a total output from the first and the second solid state light emitting element group by a calculation result of the error calculating unit, and adding the multiplication result and a third reference value obtained based on the target output ratio of the second to the first solid state light emitting element group.

Further, the first lighting control unit may include a first drive circuit which supplies a power to the first solid state light emitting element group; a first detection unit which detects the power being supplied from the first drive circuit to the first solid state light emitting element group; and a first control circuit which performs a feedback-control on the first drive circuit, and the second lighting control unit may include a second drive circuit which supplies a power to the second solid state light emitting element group; a second detection unit which detects the power being supplied from the second drive circuit to the second solid state light emitting element group; and a second control circuit which performs a feedback-control on the second drive circuit, and the lighting device described above may further include an adder which generates a total detection result by adding the detection results of the first and the second detection unit; and a dividing unit which generates a division detection result for each of the first and the second lighting control unit by dividing the total detection result in a predetermined ratio, and outputs the division detection result to each of the first and the second lighting control unit. Each of the first and the second control circuit performs a feedback control such that the division detection result outputted thereto becomes equal to a reference value set thereto.

Further, the first and the second drive circuit may respectively supply to the first and the second solid state light emitting element group a first and a second intermittent current having a first and a second ON period respectively set based on the target output ratio of the second to the first solid state light emitting element group, and the first detection unit may detect an amplitude of the first intermittent current in the first ON period, and the second detection unit may detect an amplitude of the second intermittent current in the second ON period; the adder may generate the total detection result by adding the amplitude of the first intermittent current and the amplitude of the second intermittent current, and the dividing unit may generate the division detection result by equally dividing the total detection result.

Further, the dividing unit may generate the division detection result for each of the first and the second lighting control unit by dividing the total detection result based on the target output ratio of the second to the first solid state light emitting element group, and may output the division detection result for each of the first and the second lighting control unit to the corresponding lighting control unit.

In accordance with a second embodiment of the present invention, there is provided a lighting device includes: a first lighting control unit and one or more second lighting control units provided to respectively control a first solid state light emitting element group and one or more solid state light emitting element groups irradiating lights of different chromaticities. The first lighting control unit includes: a first drive circuit which supplies a power to the first solid state light emitting element group; a first detection unit which detects the power being supplied from the first drive circuit to the first solid state light emitting element group; and a first control circuit which performs a feedback-control on the first drive circuit such that a detection result of the first detection unit becomes equal to a first reference value. Further, each of the second lighting control units includes: a second drive circuit which supplies a power to the corresponding second solid state light emitting element group; a second detection unit which detects the power being supplied from the second drive circuit to the corresponding second solid state light emitting element group; and a second control circuit which performs a feedback-control on the second drive circuit such that a detection result of the second detection unit becomes equal to a second reference value obtained based on the detection result of the first detection unit.

Further, the lighting device described above may further include an output control unit configured to vary the first reference value.

The lighting device described above may further include a color ratio setting unit which sets a target output ratio of each of the second solid state light emitting element groups to the first solid state light emitting element group. Further, the first drive circuit and the second drive circuit may respectively supply to the first solid state light emitting element group and the corresponding second solid state light emitting element group a first and a second intermittent current having a first and a second ON period respectively set based on the target output ratio of the corresponding second solid state light emitting element group to the first solid state light emitting element group. Further, the first detection unit may detect an amplitude of the first intermittent current in the first ON period, and the second detection unit may detect an amplitude of the second intermittent current in the second ON period. The first control circuit may perform a feedback control such that the amplitude of the first intermittent current becomes equal to the first reference value, and the second control circuit may perform a feedback control such that the amplitude of the second intermittent current becomes equal to the amplitude of the first intermittent current.

The lighting device described above may further include a color ratio setting unit which sets a target output ratio of each of the second solid state light emitting element groups to the first solid state light emitting element group. Further, the second reference value may generated by multiplying the target output ratio of each of the second solid state light emitting element group to the first solid state light emitting element group by the detection result of the first detection unit.

The lighting device described above may further include a color ratio setting unit which sets a target output ratio of each of the second solid state light emitting element groups to the first solid state light emitting element group; and an error calculating unit which calculates an amplified difference between the detection result of the first detection unit and the first reference value with respect to a total output from the first solid state light emitting element group and the second solid state light emitting element groups.

Further, the second reference value may be generated by multiplying a ratio of an output from each of the second solid state light emitting element groups to the total output from the first solid state light emitting element group and the second solid state light emitting element groups by a calculation result of the error calculating unit, and adding the multiplication result and a third reference value obtained based on the target output ratio of each of the second solid state light emitting element groups to the first solid state light emitting element group In accordance with a third embodiment of the present invention, there is provided an An illumination apparatus including: the lighting device described above; solid state light emitting element groups which are turned on by the lighting device; and an apparatus main body accommodating the lighting device, the solid state light emitting element groups being mounted on the apparatus main body.

As described above, in accordance with the present invention, there is an effect of reducing a deviation from a black body locus and improving color reproducibility of mixed color light of the lights irradiated by solid state light emitting element groups.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Figure 1:
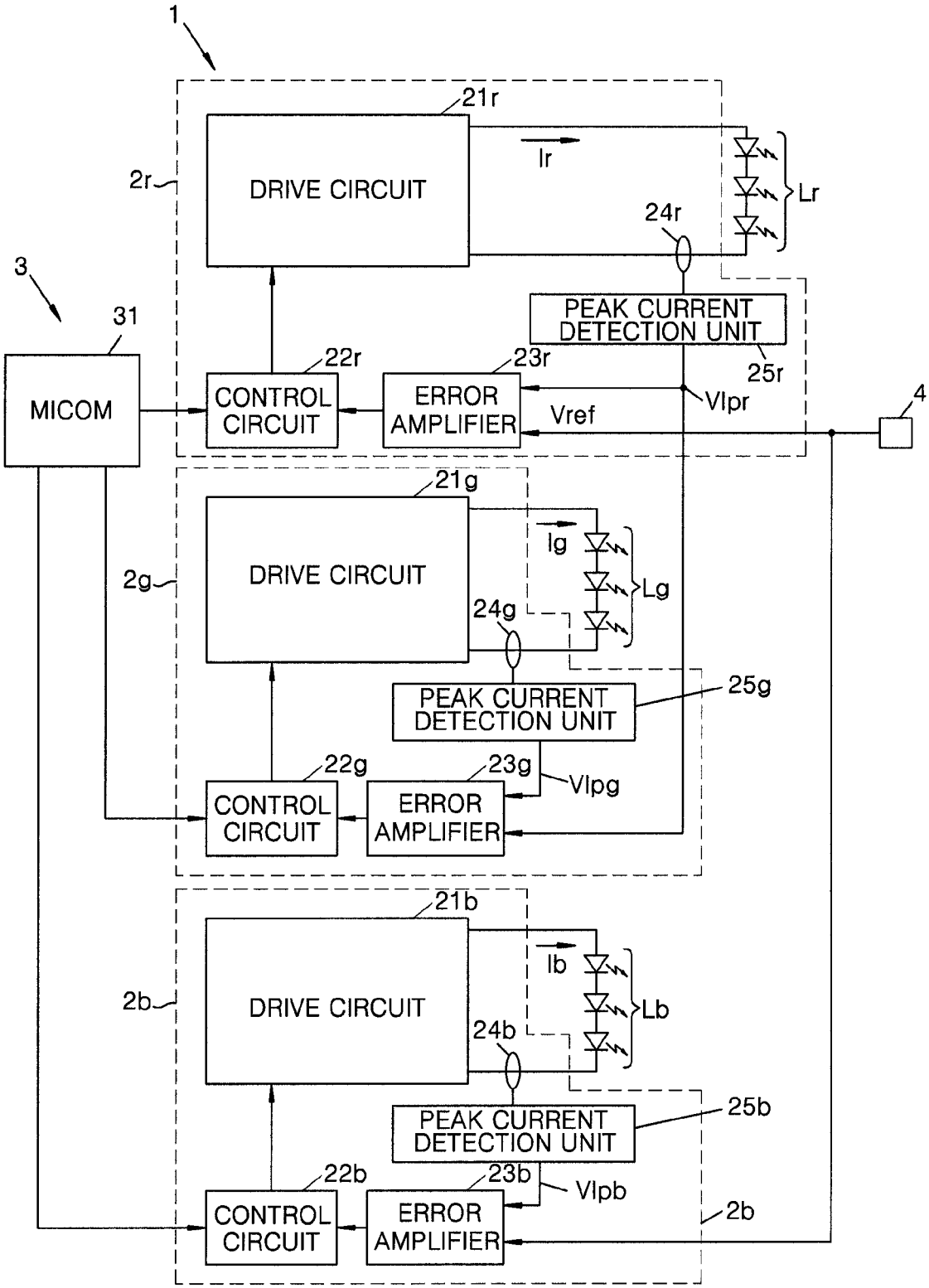
FIG. 1 illustrates a block diagram of a lighting device in accordance with a first embodiment of the present invention.

Hereinafter, embodiments of the present invention will be described with reference to the accompanying drawings which form a part hereof. Throughout the drawings, like reference numeral will be given to like parts, and redundant description thereof will be omitted.

(First Embodiment)

FIG. 1 illustrates a block diagram of a lighting device 1 in accordance with a first embodiment of the present invention.

The lighting device 1 of this embodiment turns on a solid state light emitting element group Lr irradiating a red light, a solid state light emitting element group Lg irradiating a green light, and a solid state light emitting element group Lb irradiating a blue light at a predetermined output ratio to irradiate a mixed color light thereof. The solid state light emitting element groups Lr, Lg and Lb, each including an array of three solid state light emitting elements (light emitting diodes), are configured to irradiate the red light, the green light and the blue light, respectively. In addition, if it is not necessary to separately identify each of the solid state light emitting element groups Lr, Lg and Lb, it is referred to as a solid state light emitting element group L. Although the solid state light emitting element group L of this embodiment includes an array of three solid state light emitting elements, it may include an array of a different number of solid state light emitting elements.

Figure 18:
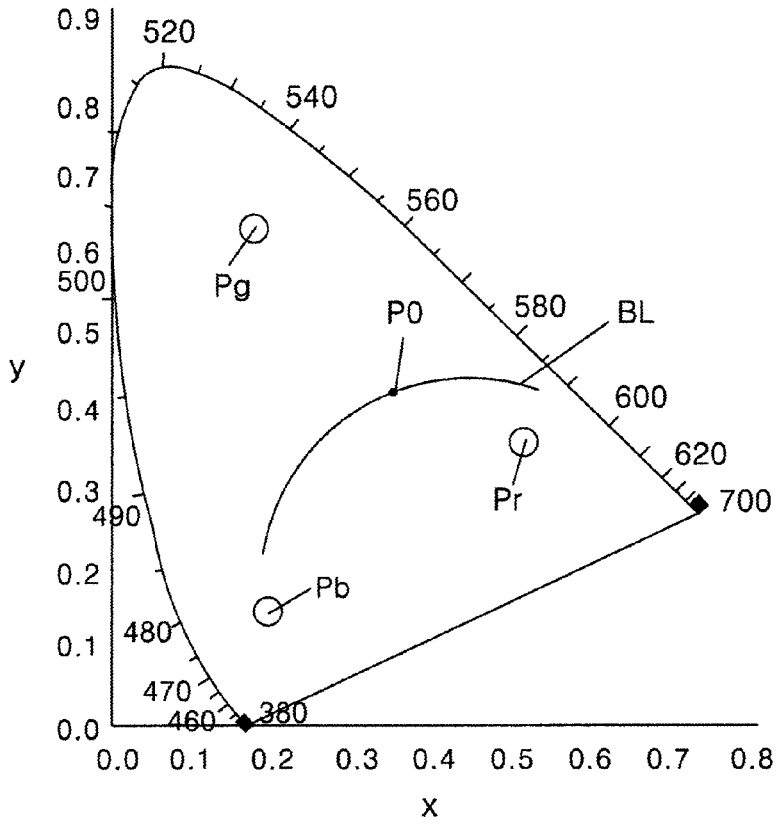
FIG. 18 (PRIOR ART)
FIG. 18 is an xy chromaticity diagram in accordance with a conventional example.
Figure 19:
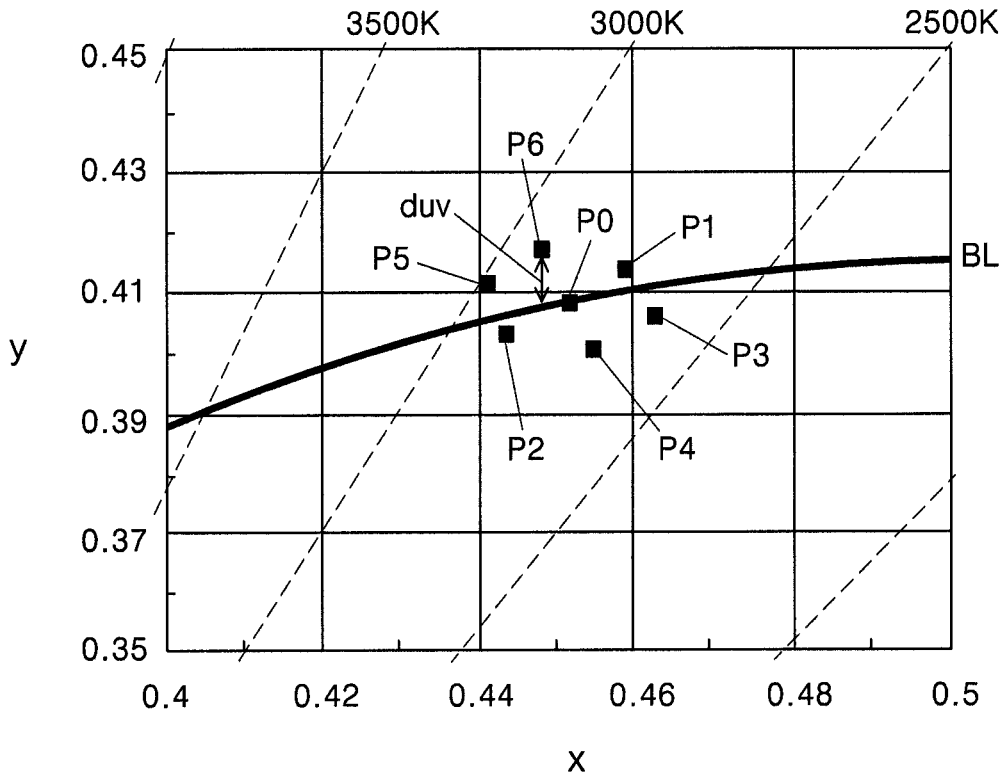
FIG. 19 (PRIOR ART)
FIG. 19 is a partially enlarged view of the xy chromaticity diagram in accordance with the conventional example.

In an xy chromaticity diagram of an XYZ color system shown in FIG. 18, a light irradiated by the solid state light emitting element group Lr has a color coordinate Pr, a light irradiated by the solid state light emitting element group Lg has a color coordinate Pg, and a light irradiated by the solid state light emitting element group Lb has a color coordinate Pb. As shown in FIG. 18, a straight line connecting the color coordinate Pr and the color coordinate Pg intersects a black body locus BL. Further, the mixed color light has a color coordinate P0 on the black body locus BL by setting the output ratio of the solid state light emitting element groups Lr, Lg and Lb to a target output ratio. Further, the chromaticity of the mixed color light is varied along the black body locus BL by varying the output ratio of the solid state light emitting element groups Lr, Lg and Lb. The solid state light emitting element group Lr corresponds to a first solid state light emitting element group described in the claims, and the solid state light emitting element group Lg corresponds to a second solid state light emitting element group described in the claims.

The lighting device 1 of this embodiment includes lighting control units 2*r*, 2*g* and 2*b* for controlling lighting of the solid state light emitting element groups Lr, Lg and Lb, a color ratio setting unit 3 for setting the target output ratio of the solid state light emitting element groups Lr, Lg and Lb, and an output control unit 4. The lighting device 1 performs a burst dimming in which the lighting control units 2*r*, 2*g* and 2*b* control respective outputs of the solid state light emitting element groups Lr, Lg and Lb by supplying an intermittent current to each of the solid state light emitting element groups Lr, Lg and Lb and controlling an ON period thereof. Further, the output ratio of the solid state light emitting element groups Lr, Lg and Lb is controlled to be equal to the target output ratio under the control of the lighting control units 2*r*, 2*g* and 2*b*. Further, the lighting control units 2*r*, 2*g* and 2*b* have the same configuration. In the following description, "r (R)" is assigned to the end of a reference numeral of a component related to the lighting control unit 2*r*, "g (G)" is assigned to the end of a reference numeral of a component related to the lighting control unit 2*g*, and "b (B)" is assigned to the end of a reference numeral of a component related to the lighting control unit 2*b*. In addition, if it is not necessary to individually identify, the alphabet at the end will be omitted.

The color ratio setting unit 3 includes a microcomputer 31 (hereinafter simply referred to as MICOM 31). The target output ratio of the solid state light emitting element groups L has been set in the MICOM 31. Further, the MICOM 31 determines an ON period of a current I being supplied to the solid state light emitting element group L from each lighting control unit 2 on the basis of the target output ratio, and sends the instructions to each lighting control unit 2. Then, each lighting control unit 2 controls the current I such that the ON period of the current I corresponds to a value instructed by the MICOM 31 and supplies the controlled current I to each light emitting element group L.

Next, a specific configuration and control of the lighting control unit 2 will be described. The lighting control unit 2 includes a drive circuit 21, a control circuit 22, an error amplifier 23, a current detection unit 24, and a peak current detection unit 25.

The drive circuit 21 turns on the solid state light emitting element group L by supplying the current I to the solid state light emitting element group L.

Figure 2:
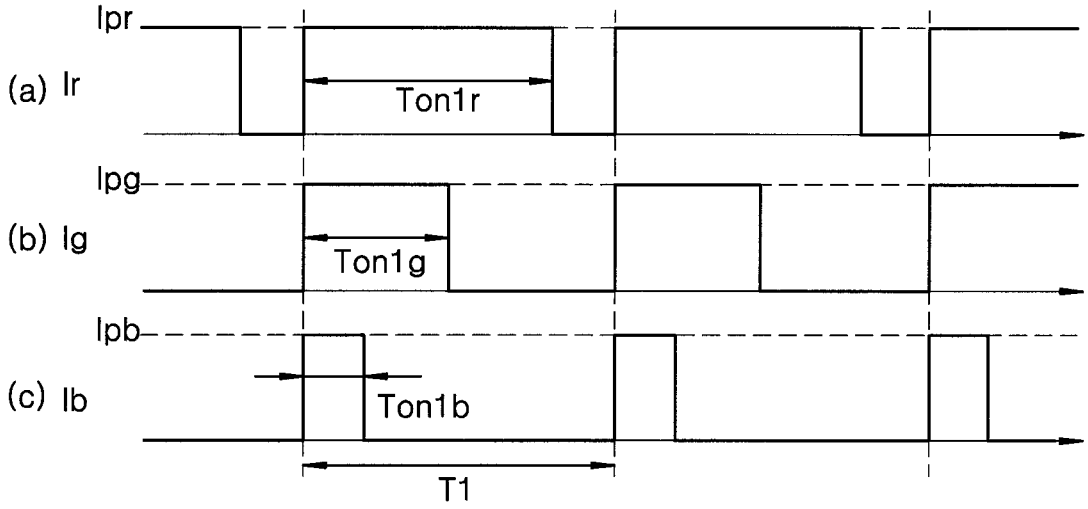
FIG. 2 illustrates waveform diagrams (a) to (c) of currents.

The control circuit 22 controls the current I by controlling the drive circuit 21. As shown in (a) to (c) of FIG. 2, each of the currents Ir, Ig and Ib is configured as an intermittent current repeating an ON and an OFF period. The control circuits 22*r*, 22*g* and 22*b* respectively control ON periods Ton1*r*, Ton1*g* and Ton1*b* in a period T1 on the basis of the instructions from the MICOM 31.

The current detection unit 24 detects the current I being supplied from the drive circuit 21 to the solid state light emitting element group L, and outputs a detection result to the peak current detection unit 25.

The peak current detection unit 25 obtains an amplitude (hereafter referred to as peak value Ip) of the current I in the ON period Toni from the detection result of the current detection unit 24, generates a detection voltage VIp corresponding to the peak value Ip, and outputs the detection voltage VIp to the error amplifier 23.

The current detection unit 24*r* and the peak current detection unit 25*r* correspond to a first detection unit described in the claims, and the current detection unit 24*g* and the peak current detection unit 25*g* correspond to a second detection unit described in the claims.

Specifically, an input terminal of the error amplifier 23*r* provided in the lighting control unit 2*r* (first lighting control unit) is connected to the peak current detection unit 25*r* and the output control unit 4. The detection voltage VIpr outputted from the peak current detection unit 25*r* and a reference voltage Vref (first reference value) outputted from the output control unit 4 are applied to an input terminal of the error amplifier 23*r*. In addition, the reference voltage Vref corresponds to a target value of the detection voltage VIpr corresponding to the peak value Ipr of the current Ir. Further, the error amplifier 23*r* outputs a difference between the detection voltage VIpr and the reference voltage Vref to the control circuit 22*r*.

An input terminal of the error amplifier 23*b* provided in the lighting control unit 2*b* is connected to the peak current detection unit 25*b* and the output control unit 4. The error amplifier 23*b* outputs a difference between the detection voltage VIpb and the reference voltage Vref to the control circuit 22*b*.

The control circuit 22*r* (first control circuit) controls the ON period Ton1*r* of the current Ir based on the instructions from the MICOM 31 as described above, and controls the drive circuit 21*r* (first drive circuit) based on the output of the error amplifier 23*r*, thereby performing a feedback control on the peak value Ipr of the current Ir. Similarly, the control circuit 22*b* controls the ON period Ton1*b* of the current Ib, and performs a feedback control on the peak value Ipb of the current Ib based on the output of the error amplifier 23*b*.

Meanwhile, even though the ON period Toni of each current I is controlled based on the instructions from the MICOM 31, a chromaticity deviation duv of the mixed color light of the lights irradiated by the light emitting element groups L may become larger if the peak value Ipr of the current Ir and the peak value Ipg of the current Ig are relatively different from each other. In such case, the chromaticity of the mixed color light of the lights irradiated by the solid state light emitting element groups L becomes significantly different from a desired chromaticity.

However, in this embodiment, an input terminal of the error amplifier 23*g* provided in the lighting control unit 2*g* (second lighting control unit) is connected to the peak current detection unit 25*g* and the peak current detection unit 25*r*. The detection voltage VIpg outputted from the peak current detection unit 25*g* and the detection voltage VIpr outputted from the peak current detection unit 25*r* are applied to the error amplifier 23*g*. In other words, the detection voltage VIpr becomes a reference value (target value) of the detection voltage VIpg corresponding to the peak value Ipg of the current Ig. Further, the error amplifier 23*g* outputs a difference between the detection voltage VIpg and the detection voltage VIpr to the control circuit 22*g*.

The current detection unit 24*g* and the peak current detection unit 25*g* correspond to a second detection unit described in the claims, and the detection voltage VIpr corresponds to a second reference value described in the claims.

The control circuit 22*g* (second control circuit) controls the ON period Ton1*g* of the current Ig based on the instructions from the MICOM 31 as described above, and performs a feedback-control on the drive circuit 21*g* (second drive circuit) based on the output of the error amplifier 23*g*. That is, the control circuit 22*g* performs the feedback control such that the peak value Ipg of the current Ig becomes equal to the peak value Ipr of the current Ir.

As described above, in this embodiment, based on the output from one (solid state light emitting element group Lr) of the solid state light emitting element groups Lr and Lg irradiating lights of the color coordinates Pr and Pg while the black body locus BL is located therebetween, the feedback control on the output of the other one (solid state light emitting element group Lg) is performed. For example, if the peak value Ipr of the current Ir increases, the peak value Ipg of the current Ig also increases. In other words, the deviation of the output ratio of the solid state light emitting element groups Lr and Lg from the target output ratio is reduced. Accordingly, the chromaticity deviation duv of the mixed color light of the lights irradiated by the light emitting element groups L is reduced and the color reproducibility can be improved.

Further, in this embodiment, the output from the lighting control unit 2*g* is feedback-controlled on the basis of the output from the lighting control unit 2*r*, but the output from the lighting control unit 2*r* may be feedback-controlled on the basis of the output from the lighting control unit 2*g*.

In addition, in this embodiment, if the reference voltage Vref outputted from the output control unit 4 is varied, the peak value Ip of each current I is varied. That is, merely by varying the reference voltage Vref, the output of the mixed color light of the lights irradiated by the light emitting element groups L can be varied while maintaining the color temperature thereof. Thus, the output of the mixed color light can be easily adjusted.

Further, although the mixed color light is irradiated by the solid state light emitting element group Lr irradiating the red light, the solid state light emitting element group Lg irradiating the green light and the solid state light emitting element group Lb irradiating the blue light in this embodiment, the solid state light emitting element groups L irradiating lights of other colors may be used. For example, the solid state light emitting element group L irradiating a white light with a high color temperature instead of the blue light may be used. Further, although the solid state light emitting element groups L of three colors are used to irradiate the mixed color light, it may be configured to irradiate the mixed color light of the lights from the light emitting element groups L of a different number of colors.

(Second Embodiment)

Figure 3:
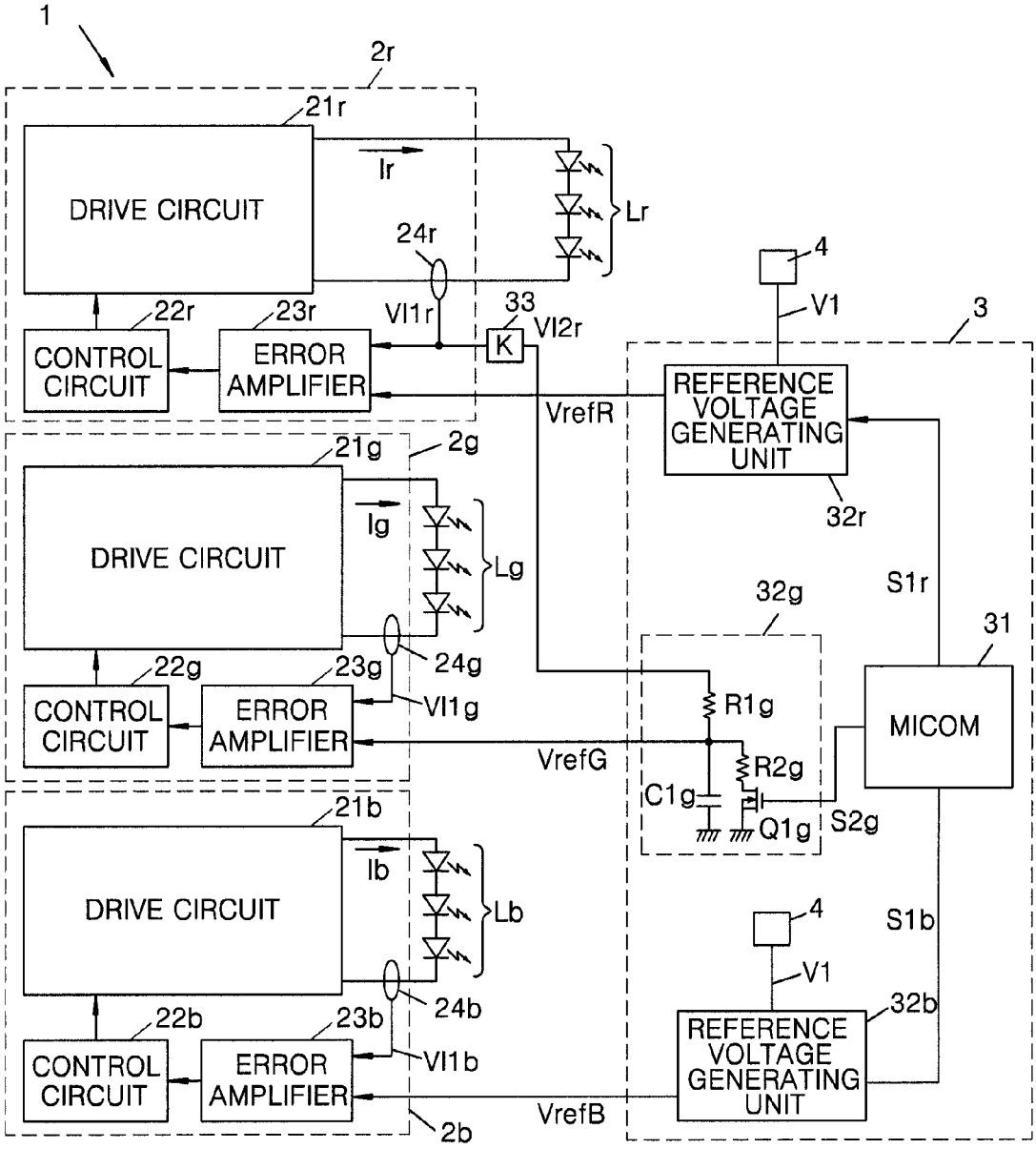
FIG. 3 illustrates a block diagram of a lighting device in accordance with a second embodiment of the present invention.

FIG. 3 illustrates a block diagram of a lighting device 1 in accordance with a second embodiment of the present invention. Like reference numerals will be given to like parts common to the first embodiment, and a redundant description thereof will be omitted.

The lighting device 1 of this embodiment performs an amplitude dimming in which lighting control units 2*r*, 2*g* and 2*b* supply DC currents (steady-state currents) to solid state light emitting element groups Lr, Lg and Lb and control amplitudes of the currents to control outputs from the solid state light emitting element groups Lr, Lg and Lb, respectively. Further, the lighting control units 2*r*, 2*g* and 2*b* control such that an output ratio of the solid state light emitting element groups Lr, Lg and Lb becomes same as a target output ratio.

A color ratio setting unit 3 of this embodiment includes a MICOM 31, and reference voltage generating units 32*r*, 32*g* and 32*b*.

The reference voltage generating units 32*r* and 32*b* generate reference voltages VrefR and VrefB based on control signals S1*r* and S1*b* outputted from the MICOM 31 by using, as a source voltage, a control voltage V1 outputted from the output control unit 4. As shown in (a) to (c) of FIG. 4, each of the control signals S1*r* and S1*b* is a PWM signal, and the MICOM 31 determines ON periods Ton2*r* and Ton2*b* of the control signals S1*r* and S1*b* based on respective target outputs from the solid state light emitting element groups Lr and Lb. Therefore, the generated reference voltages VrefR and VrefB are V1×Ton2*r*/T2 and V1×Ton2*b*/T2, respectively (i.e., VrefR=V1×Ton2*r*/T2, VrefB=V1×Ton2*b*/T2, where T2 is the period of each of the control signals S1*r* and S1*b*).

Further, the reference voltage generating units 32*r* and 32*b* output the generated reference voltages VrefR and VrefB to the error amplifiers 23*r* and 23*b*, respectively. The reference voltages VrefR and VrefB respectively correspond to target amplitudes of currents Ir and Ib being supplied to the solid state light emitting element groups Lr and Lb, and the reference voltage VrefR corresponds to the first reference value described in the claims.

Further, each current detection unit 24 detects the amplitude of the current I being supplied to the solid state light emitting element group L, and outputs a detection voltage VI1 corresponding to the amplitude of the current I to the error amplifier 23. Further, in this embodiment, the current detection unit 24*r* corresponds to the first detection unit, and the current detection unit 24*g* corresponds to the second detection unit.

Therefore, an input terminal of the error amplifier 23*r* is connected to the reference voltage generating unit 32*r* and the current detection unit 24*r*. The error amplifier 23*r* outputs a difference between the reference voltage VrefR and the detection voltage VI1*r* to the control circuit 22*r*. Similarly, an input terminal of the error amplifier 23*b* is connected to the reference voltage generating unit 32*b* and the current detection unit 24*b*. The error amplifier 23*b* outputs a difference between the reference voltage VrefB and the detection voltage VI1*b* to the control circuit 22*b*.

The control circuits 22*r* and 22*b* perform feedback controls on the amplitudes of the currents Ir and Ib based on the outputs from the error amplifiers 23*r* and 23*b*, respectively, such that the detection voltages VI1*r* and VI1*b* become equal to the respective reference voltages VrefR and VrefB.

In addition, in this embodiment, an output terminal of the current detection unit 24*r* is connected to the reference voltage generating unit 32*g* through an amplifier 33. The amplifier 33 generates an amplification voltage VI2*r* obtained by amplifying the detection voltage VIr outputted from the current detection unit 24*r* by K times (K=real number greater than 1) and outputs the amplification voltage VI2*r* to the reference voltage generating unit 32*g*.

The reference voltage generating unit 32*g* includes resistors R1*g* and R2*g*, a switching element Q1*g* and a capacitor Cig. The resistors R1*g* and R2*g* and the switching element Q1*g* are connected in series, and the capacitor C1*g* is connected in parallel to a series circuit of the resistor R2*g* and the switching element Q1*g*. An output terminal of the amplifier 33 is connected to the error amplifier 23*g* through the resistor R1*g*. Further, the switching element Q1*g* is formed of an n-channel MOSFET and interposed between the resistor R2*g* and the ground. A gate of the switching element Q1*g* is connected to the MICOM 31, and the switching element Q1*g* is turned on and off based on a control signal S2*g* to make an electrical connection and disconnection between the resistor R2*g* and the ground. Accordingly, a reference voltage VrefG, which is obtained by smoothing (dividing) the amplification voltage VI2*r* based on an ON period Ton3*g* of the control signal S2*g*, is generated across the capacitor C1*g*.

Figure 4:
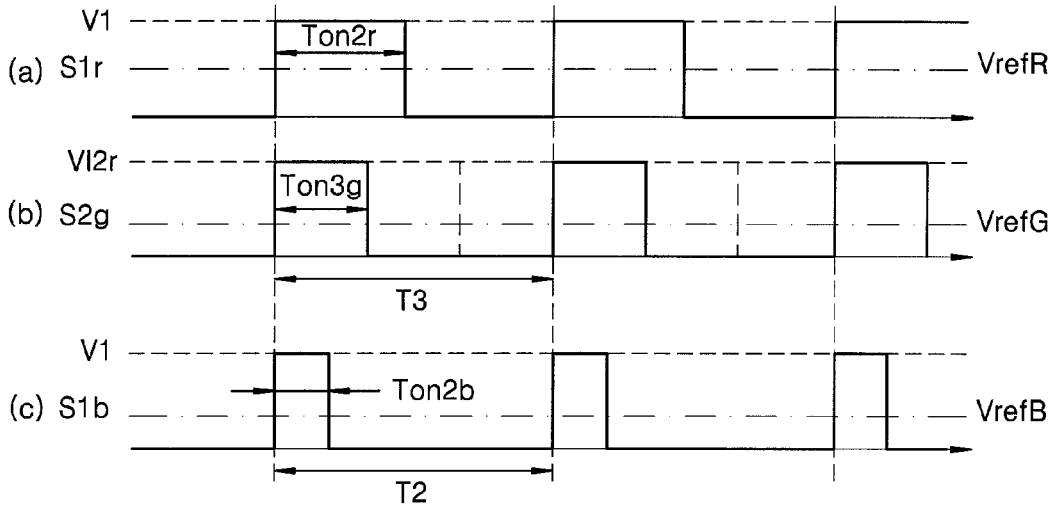
FIG. 4 illustrates waveform diagrams (a) to (c) of control signals.

The control signal S2*g* outputted from the MICOM 31 to the switching element Q1*g* is a PWM signal as shown in (b) of FIG. 4. The ON period Ton3*g* in a period T3 of the control signal S2*g* is determined based on the target output ratio. Specifically, the ON period Ton3*g* is determined such that the target output ratio of the solid state light emitting element group Lg to the solid state light emitting element group Lr becomes equal to a ratio of the ON period Ton3*g* to the period T3. Therefore, the reference voltage VrefG generated by the reference voltage generating unit 32*g* is VI2r×Ton3*g*/T3 (VrefG=VI2*r*×Ton3*g*/T3). The reference voltage VrefG corresponds to the second reference value described in the claims, which is a target amplitude of the current Ig being supplied to the solid state light emitting element group Lg. Further, in this embodiment, as shown in (a) to (c) of FIG. 4, the period T2 of the control signals S1*r* and S1*b* is equal to the period T3 of the control signal s2*g*.

Then, the error amplifier 23*g* outputs a difference between the reference voltage VrefG and the detection voltage VI1*g* to the control circuit 22*g*. The control circuit 22*g* performs a feedback control on an amplitude of the current Ig based on an output of the error amplifier 23*g* such that the detection voltage VI1*g* becomes equal to the reference voltage VrefG.

Figure 5:
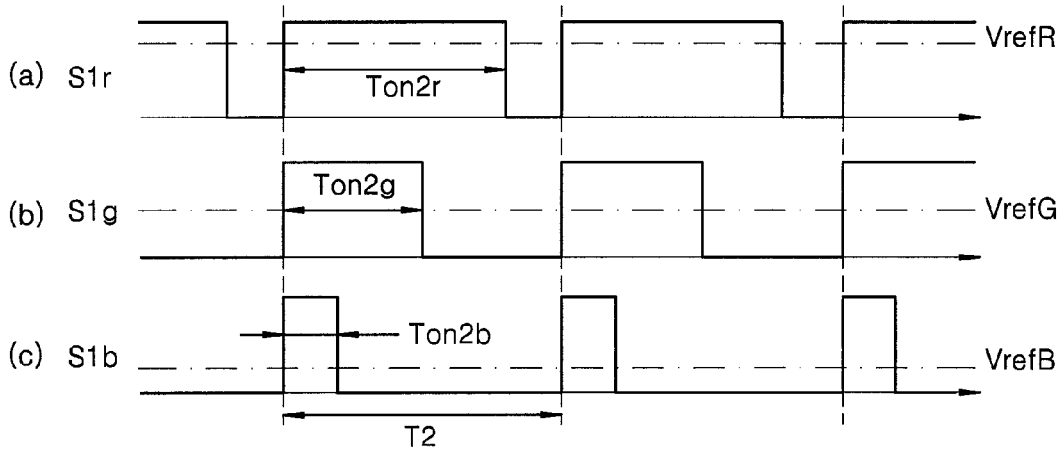
FIG. 5 (PRIOR ART)
FIG. 5 illustrates waveform diagrams (a) to (c) of control signals in accordance with a conventional example.

In the conventional case, as shown in (a) to (c) of FIG. 5, the control voltage V1 is controlled to be smoothed (divided) based on the control signals S1*r*, S1*g* and S1*b* to generate respective reference voltages VrefR, VrefG and VrefB such that a ratio of the generated reference voltages VrefR, VrefG and VrefB becomes a target output ratio. However, an amplitude of the current I may be deviated from a target value due to an offset of the error amplifier 23 or variations in parts of the drive circuit 21. Thus, it becomes difficult to improve color reproducibility of a mixed color light of the lights from the light emitting element groups L since it is required to adjust an output of each individual light emitting element group L.

On the other hand, in this embodiment, based on the output of the lighting control unit 2*r*, the reference voltage VrefG of the lighting control unit 2*g* is generated, and the feedback control on the current Ig is performed. Accordingly, even if the amplitude of the current Ir outputted by the lighting control unit 2*r* is varied from the target value (reference voltage VrefR), the reference voltage VrefG is generated in consideration of such variation. Accordingly, the amplitude of the current Ig is varied in the same way as the current Ir, and thus the deviation of the output ratio of the solid state light emitting element groups Lr and Lg from the target output ratio is reduced. Thus, the deviation duv of the mixed color light of the lights irradiated by the light emitting element groups L is reduced and the color reproducibility can be improved.

Further, in this embodiment, the amplifier 33 is used to generate the amplification voltage VI2*r* by amplifying the detection voltage VI1*r* by K times, and the reference voltage VrefG is generated by smoothing the amplification voltage VI2*r*. Therefore, as represented by a dashed line in (b) of FIG. 4, by increasing the ON period Ton3*g*, the reference voltage VrefG can be made greater than the detection voltage VI1*r*, and the output from the solid state light emitting element group Lg can be made greater than the output from the solid state light emitting element group Lr. Further, if the target output from the solid state light emitting element group Lr is consistently greater than the target output of the solid state light emitting element group Lg, the amplifier 33 may be omitted and it may be configured to generate the reference voltage VrefG by smoothing the detection voltage VI1*r*.

Figure 6:
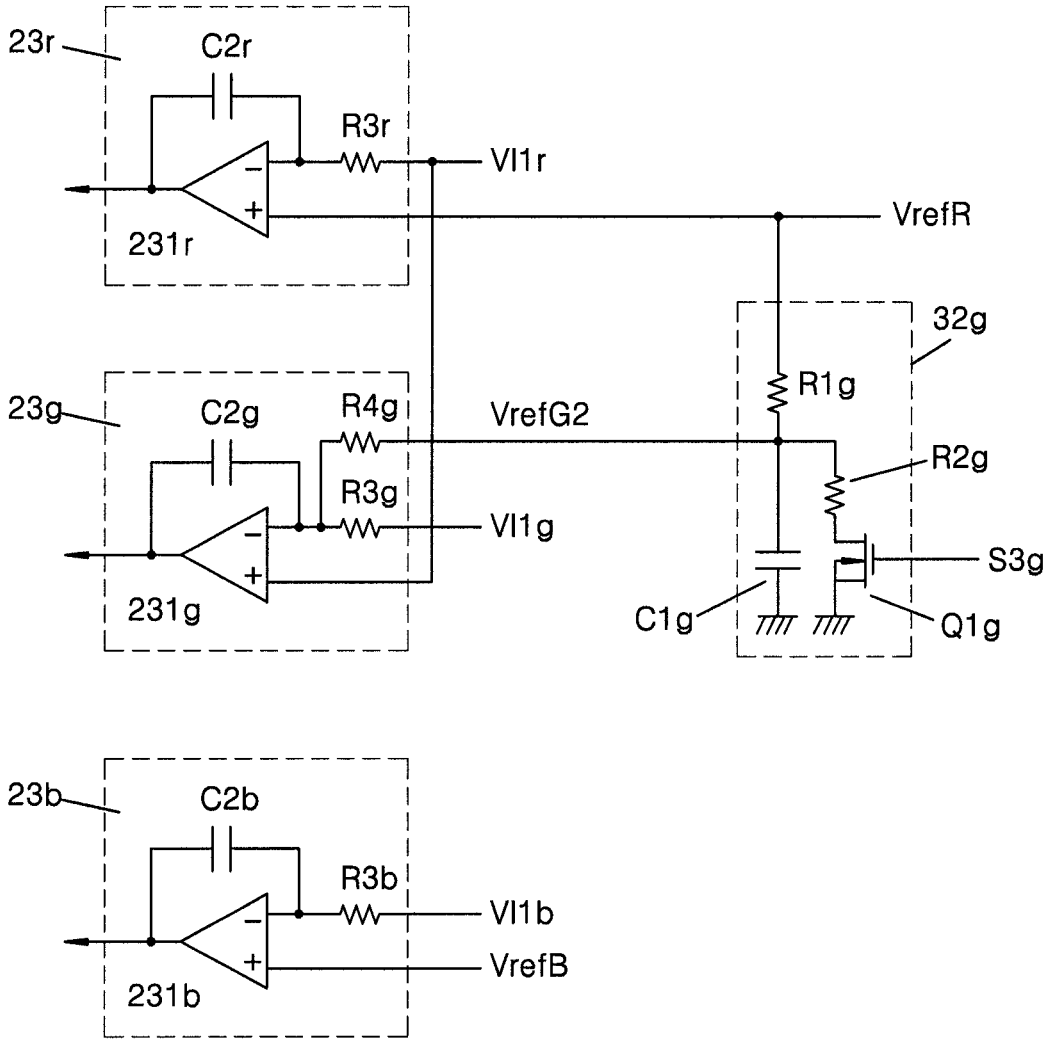
FIG. 6 is a circuit diagram showing another configuration of an error amplifier.

Further, if the target output from the solid state light emitting element group Lr is consistently greater than the target output of the solid state light emitting element group Lg, the error amplifier 23 may be configured as shown in FIG. 6.

The error amplifier 23*r* includes an operational amplifier 231*r*, a capacitor C2*r* and a resistor R3*r*. In the operational amplifier 231*r*, the reference voltage VrefR is applied to its non-inverting input terminal, and the detection voltage VI1*r* is applied to its inverting input terminal through the resistor R3*r*. Further, the capacitor C2*r* is inserted between the inverting input terminal and the output terminal. Further, the control circuit 22*r* performs the feedback control on the amplitude of the current Ir based on the output of the operational amplifier 231*r* such that the detection voltage VI1*r* becomes equal to the reference voltage VrefR. Further, since the error amplifier 23*b* has the same configuration as the error amplifier 23*r*, a description thereof will be omitted.

Further, the error amplifier 23*g* includes an operational amplifier 231*g*, a capacitor C2*g* and resistors R3*g* and R4*g*. In the operational amplifier 231*g*, the detection voltage VI1*r* is applied to its non-inverting input terminal, and a voltage obtained by adding the detection voltage VI1*g* applied through the resistor R3*g* and a reference voltage VrefG2 applied through the resistor R4*g* is applied to its inverting input terminal.

The reference voltage generating unit 32*g* uses the reference voltage VrefR as a source voltage and generates the reference voltage VrefG2 obtained by smoothing the reference voltage VrefR based on a control signal S3*g* outputted from the MICOM 31.

A control signal S3*g* is a PWM signal, and the on-duty is determined on the basis of the target output ratio. Specifically, the on-duty of the control signal S3*g* is determined to be a difference between the target output of the solid state light emitting element group Lr and the target output of the solid state light emitting element group Lg with respect to the target output of the solid state light emitting element group Lr. If the target outputs of the solid state light emitting element groups Lr and Lg are VrefR and VrefG, "difference of the target outputs of the solid state light emitting element groups Lr and Lg with respect to the target output of the solid state light emitting element group Lr" is equivalent to (1−VrefG/

VrefR). Accordingly, the reference voltage VrefG2 generated by the reference voltage generating unit 32*g* becomes VrefR×(1−VrefG/VrefR).

Then, the control circuit 22*g* performs the feedback control such that the detection voltage VI1*r* becomes equal to a sum of the detection voltage VI1*g* and the reference voltage VrefG2. That is, equivalently, the feedback control on the amplitude of the current Ig is performed based on a reference value obtained by subtracting the reference voltage VrefG2, which is the target output difference, from the output (detection voltage VI1*r*) of the lighting control unit 2*r*.

Thus, since the feedback control of the amplitude of the current Ig is performed based on the amplitude of the current Ir, the same effect as described above can be obtained, and the deviation of the output ratio of the solid state light emitting element groups Lr and Lg from the target output ratio is reduced. Thus, the deviation duv of the mixed color light of the lights irradiated by the light emitting element groups L is reduced and the color reproducibility can be improved.

(Third Embodiment)

Figure 7:
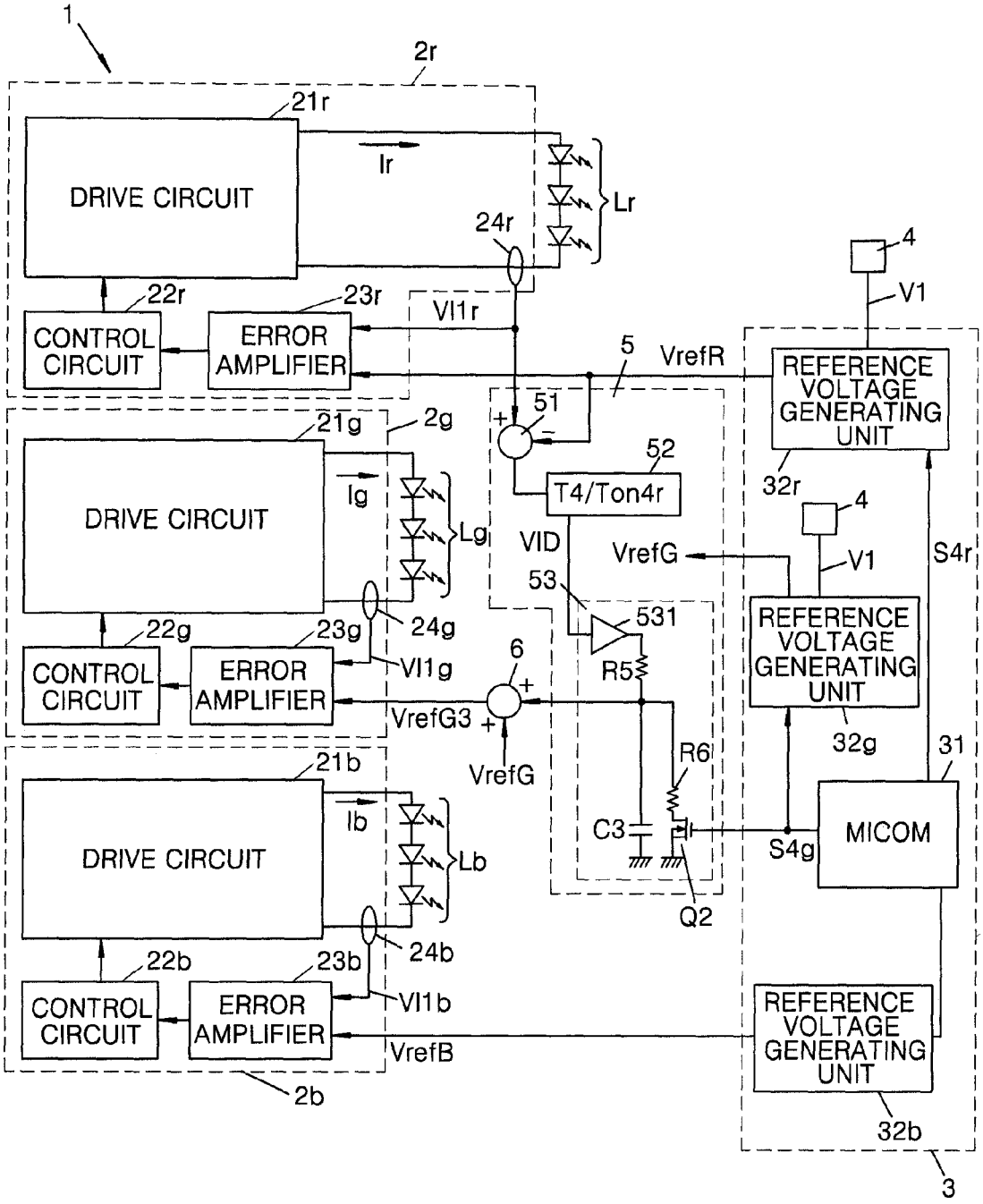
FIG. 7 illustrates a block diagram of a lighting device in accordance with a third embodiment of the present invention.

FIG. 7 illustrates a block diagram of a lighting device 1 in accordance with a third embodiment of the present invention. Like reference numerals will be given to like parts common to the second embodiment, and a redundant description thereof will be omitted.

The lighting device 1 of this embodiment performs an amplitude dimming in which lighting control units 2*r*, 2*g* and 2*b* supply DC currents to solid state light emitting element groups Lr, Lg and Lb and control amplitudes thereof to control outputs from the solid state light emitting element groups Lr, Lg and Lb, respectively. Further, the lighting control units 2*r*, 2*g* and 2*b* control such that an output ratio of the solid state light emitting element groups Lr, Lg and Lb becomes same as a target output ratio.

The lighting device 1 includes the lighting control units 2*r*, 2*g* and 2*b*, a color ratio setting unit 3, an output control unit 4, an error calculating unit 5, and an adder 6.

Reference voltage generating units 32*r* and 32*g* generate reference voltages VrefR and VrefG based on control signals S4*r* and S4*g* outputted from a MICOM 31 by using, as a source voltage, a control voltage V1 outputted from the output control unit 4.

Figure 8:
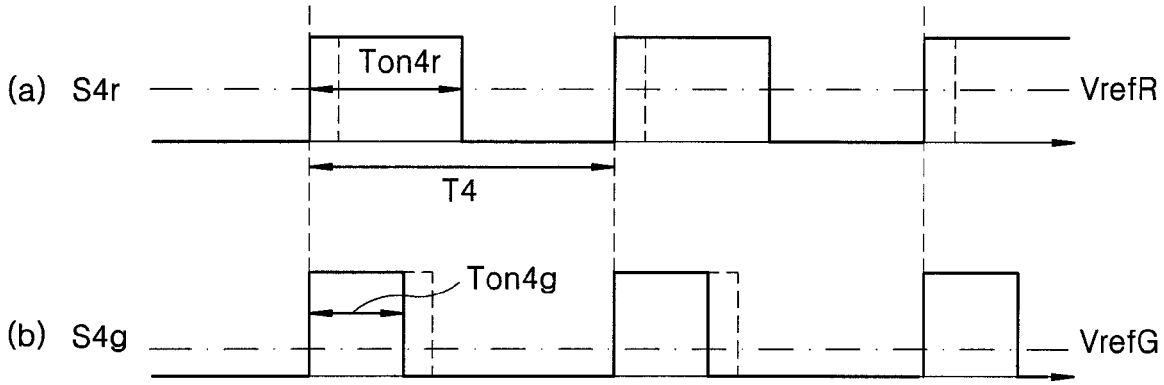
FIG. 8 illustrates waveform diagrams (a) and (b) of control signals.

As shown in (a) and (b) of FIG. 8, each of the control signals S4*r* and S4*g* is a PWM signal, and the MICOM 31 determines ON periods Ton4*r* and Ton4*g* of the control signals S4*r* and S4*g* based on the target output ratio. Specifically, the MICOM 31 determines the ON periods Ton4*r* and Ton4*g* such that ratios of the respective ON periods Ton4*r* and Ton4*g* to a period T4 (i.e., Ton4*r*/T4 and Ton4*g*/T4) become equal to ratios of the respective outputs of the solid state light emitting element groups Lr and Lg to the total output of the solid state light emitting element groups Lr and Lg (i.e., Lr/(Lr+Lg) and Lg/(Lr+Lg)). That is, the period T4 corresponds to the total output of the solid state light emitting element groups Lr and Lg, and the MICOM 31 determines each of the ON periods Ton4*r* and Ton4*g* based on the target output ratio such that a sum of the ON periods Ton4*r* and Ton4*g* becomes equal to the period T4 (i.e., Ton4*r*+Ton4*g*=T4).

Then, the reference voltage generating units 32*r* and 32*g* generate reference voltages VrefR and VrefG obtained by smoothing (dividing) the control voltage V1 outputted from the output control unit 4 based on the control signals S4*r* and S4*g*. That is, the control voltage V1 corresponds to the total output of the light emitting element groups Lr and Lg, and the control voltage V1 is divided into the reference voltages VrefR and VrefG on the basis of the target output ratio. Thus, the reference voltages VrefR and VrefG are given by V1×Ton4*r*/T4 and V1×Ton4*g*/T4, respectively.

Further, a reference voltage generating unit 32*b* generates a reference voltage VrefB based on the instructions from the MICOM 31 such that the ratio of the reference voltages VrefR, VrefG and VrefB becomes equal to the target output ratio of the solid state light emitting element groups Lr, Lg and Lb, and outputs the reference voltage VrefB to an error amplifier 23*b*.

An error amplifier 23*r* outputs a difference between a detection voltage VI1*r* and the reference voltage VrefR to a control circuit 22*r*. The control circuit 22*r* performs a feedback control on an amplitude of a current Ir such that the detection voltage VIr becomes equal to the reference voltage VrefR. Similarly, the error amplifier 23*b* outputs a difference between a detection voltage VI1*b* and the reference voltage VrefB to a control circuit 22*b*. The control circuit 22*b* performs a feedback control on an amplitude of a current Ib such that the detection voltage VIb becomes equal to the reference voltage VrefB.

An error may occur between the detection voltage VI1*r* and the reference voltage VrefR due to an offset of the error amplifier 23*r* or variations in parts of the drive circuit 21. In this embodiment, such error can be detected and the reference voltage VrefG can be corrected on the basis of the target output ratio.

The error calculating unit 5 includes a subtractor 51, an amplifier 52 and a smoothing unit 53.

The subtractor 51 has an input terminal, which is connected to a current detection unit 24*r* and the reference voltage generating unit 32*r*, and outputs to the amplifier 52 a value obtained by subtracting the reference voltage VrefR from the detection voltage VI1*r*. The amplifier 52 generates an error voltage VID obtained by amplifying an output from the subtractor 51 by (T4/Ton4*r*) times, and outputs the error voltage VID to the smoothing unit 53. Further, the error voltage VID corresponds to an error in the total current of the currents Ir and Ig.

The smoothing unit 53 includes a follower 531, resistors R5 and R6, a capacitor C3, and a switching element Q2. The follower 531, the resistors R5 and R6 and the switching element Q2 are connected in series, and the capacitor C3 is connected in parallel to a series circuit of the resistor R6 and the switching element Q2. The switching element Q2 is formed of an n-channel MOSFET and interposed between the resistor R6 and the ground. A gate of the switching element Q2 is connected to the MICOM 31, and the switching element Q2 is turned on and off based on a control signal S4*g* to make an electrical connection and disconnection between the resistor R6 and the ground, thereby varying an error voltage VIDg generated across the capacitor C3. Further, the control signal S4*g* outputted to the switching element Q2 is the same as the control signal S4*g* outputted to the reference voltage generating unit 32*g*. That is, the error voltage VIDg is obtained by dividing the error voltage VID based on the target output ratio, and the error voltage VIDg is given by VID×Ton4*g*/T4.

The adder 6 has an input terminal, which is connected to the reference voltage generating unit 32*g* and the smoothing unit 53, and generates a reference voltage VrefG3 obtained by adding the reference voltage VrefG and the error voltage VIDg. Further, the adder 6 outputs the reference voltage VrefG3 to the error amplifier 23*g*. Then, a control circuit 22*g* performs a feedback control on an amplitude of the current Ig based on an output of the error amplifier 23*g* such that a detection voltage VI1*g* becomes equal to the reference voltage VrefG3. Further, in this embodiment, the reference voltage VrefG corresponds to a third reference value described in the claims, and the reference voltage VrefG3 corresponds to a second reference value described in the claims.

As described above, in this embodiment, the reference voltage VrefG3 is generated by detecting the error between the detection voltage VI1*r* and the reference voltage VrefR and correcting the reference voltage VrefG based on the detected error. Then, the feedback control is performed based on the reference voltage VrefG3. That is, the reference voltage VrefG3 to which the output error of the lighting control unit 2*r* is applied is used as a reference value to perform the feedback control on the amplitude of the current Ig. Accordingly, the amplitude of the current Ig is varied in the same way as the error in the amplitude of the current Ir, and thus the deviation in the output ratio of the solid state light emitting element groups Lr and Lg from the target output ratio is reduced. Thus, the deviation duv of the mixed color light of the lights irradiated by the light emitting element groups L is reduced and the color reproducibility can be improved.

(Fourth Embodiment)

Figure 9:
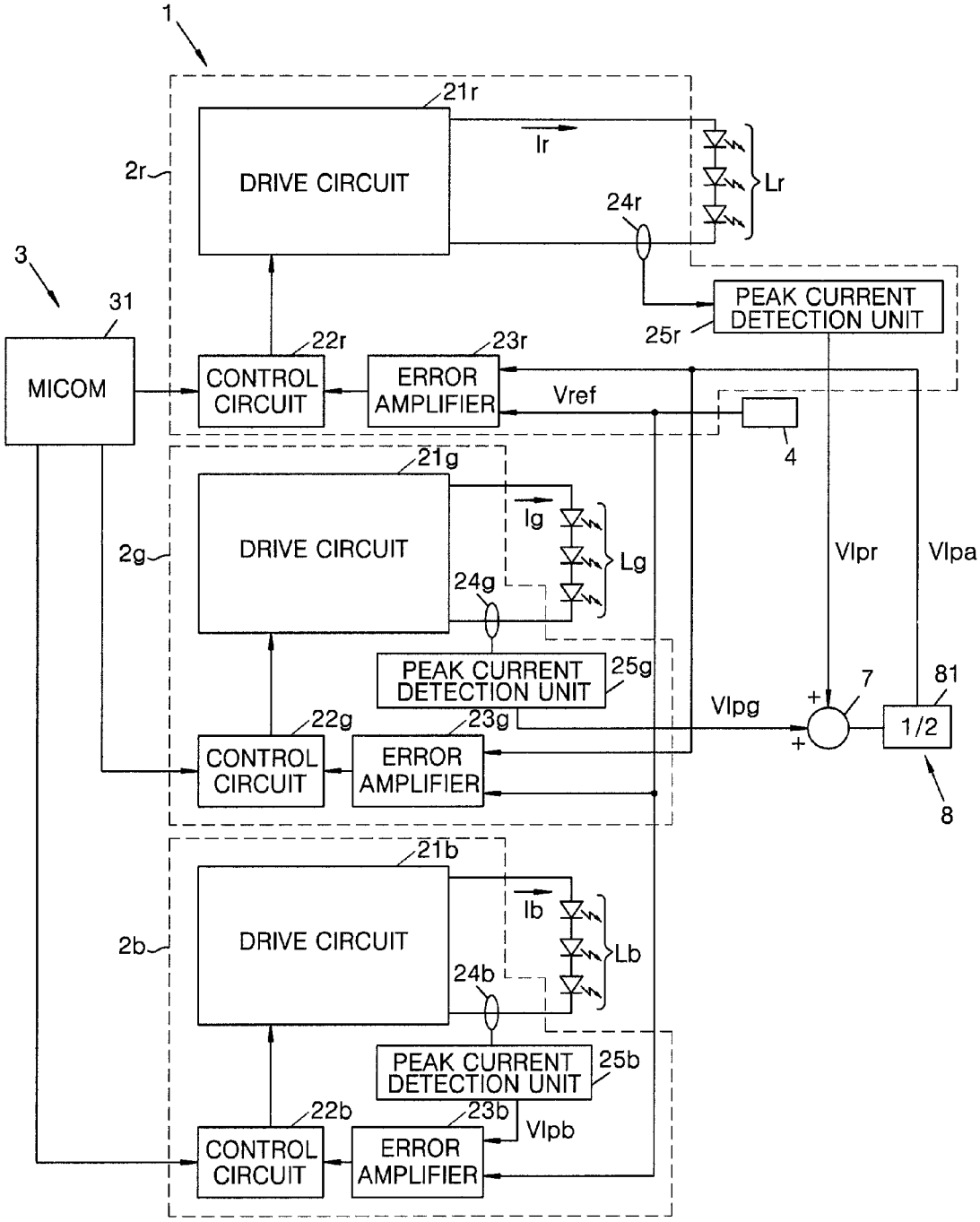
FIG. 9 illustrates a block diagram of a lighting device in accordance with a fourth embodiment of the present invention.

FIG. 9 illustrates a block diagram of a lighting device 1 in accordance with a fourth embodiment of the present invention. Like reference numerals will be given to like parts common to the first embodiment, and a redundant description thereof will be omitted.

The lighting device 1 of this embodiment includes lighting control units 2*r*, 2*g* and 2*b* for controllably turning on and off solid state light emitting element groups Lr, Lg and Lb, a color ratio setting unit 3 for setting a target output ratio of the solid state light emitting element groups Lr, Lg and Lb, an output control unit 4, an adder 7 and a dividing unit 8. Then, the lighting device 1 performs a burst dimming in which the lighting control units 2*r*, 2*g* and 2*b* control respective outputs of the solid state light emitting element groups Lr, Lg and Lb by supplying intermittent currents to the corresponding solid state light emitting element groups Lr, Lg and Lb and controlling ON periods thereof. Further, the output ratio of the solid state light emitting element groups Lr, Lg and Lb is controlled to be equal to the target output ratio under the control of the lighting control units 2*r*, 2*g* and 2*b*.

The color ratio setting unit 3 includes a MICOM 31. The target output ratio of the solid state light emitting element groups L has been set in the MICOM 31. Further, the MICOM 31 determines an ON period of a current I being supplied to the solid state light emitting element group L from each lighting control unit 2 on the basis of the target output ratio, and sends the instructions to each lighting control unit 2. Then, each lighting control unit 2 controls the current I such that the ON period of the current I corresponds to a value instructed by the MICOM 31 and supplies the controlled current I to each light emitting element group L. Further, in this embodiment, the lighting control unit 2*r* corresponds to the first lighting control unit described in the claims, and the lighting control unit 2*g* corresponds to the second lighting control unit described in the claims.

Next, a specific configuration and control of the lighting control unit 2 will be described. The lighting control unit 2 includes a drive circuit 21, a control circuit 22, an error amplifier 23, a current detection unit 24, and a peak current detection unit 25.

The drive circuit 21 turns on the solid state light emitting element group L by supplying the current I to the solid state light emitting element group L. Further, in this embodiment, the drive circuit 21*r* corresponds to the first drive circuit described in the claims, and the drive circuit 21*g* corresponds to the second drive circuit described in the claims.

The control circuit 22 controls the current I by controlling the drive circuit 21. As shown in (a) to (c) of FIG. 2, each of the currents Ir, Ig and Ib is configured as an intermittent current repeating the ON period and the OFF period. The control circuits 22*r*, 22*g* and 22*b* respectively control ON periods Ton1*r*, Ton1*g* and Ton1*b* in the period T1 on the basis of the instructions from the MICOM 31. Further, in this embodiment, the control circuit 22*r* corresponds to the first control circuit described in the claims, and the control circuit 22*g* corresponds to the second control circuit described in the claims.

The current detection unit 24 detects the current I being supplied from the drive circuit 21 to the solid state light emitting element group L, and outputs the detection result to the peak current detection unit 25.

The peak current detection unit 25 obtains an amplitude (hereafter referred to as peak value Ip) of the current I in the ON period Toni from the detection result of the current detection unit 24, and generates a detection voltage VIp corresponding to the peak value Ip. Further, the peak current detection units 25*r* and 25*g* generate the detection voltage VIpr and VIpg, and output the detection voltage VIpr and VIpg to the adder 7.

In this embodiment, the current detection unit 24*r* and the peak current detection unit 25*r* correspond to the first detection unit described in the claims, and the current detection unit 24*g* and the peak current detection unit 25*g* correspond to the second detection unit described in the claims.

The adder 7 generates a total detection voltage VIpt (=VIpr+VIpg) obtained by adding the detection voltages VIpr and VIpg respectively outputted from the peak current detection units 25*r* and 25*g*, and outputs the total detection voltage VIpt to the dividing unit 8.

The dividing unit 8 includes a voltage divider 81, and equally divides the total detection voltage VIpt outputted from the adder 7. That is, the voltage divider 81 generates an average detection voltage VIpa (=(VIpr+VIpg)/2), which is an average value of the detection voltages VIpr and VIpg. Then, the voltage divider 81 outputs the generated average detection voltage VIpa to the error amplifiers 23*r* and 23*g*. Further, the average detection voltage VIpa corresponds to the division detection result described in the claims.

Input terminals of the error amplifiers 23*r* and 23*g* are connected to the voltage divider 81 and the output control unit 4. A difference between the average detection voltage VIpa outputted from the voltage divider 81 and a reference voltage Vref outputted from the output control unit 4 is outputted to the control circuits 22*r* and 22*g*. Further, an input terminal of the error amplifier 23*b* is connected to the peak current detection unit 25*b* and the output control unit 4, and a difference between the detection voltage VIpb and the reference voltage Vref is outputted to the control circuit 22*b*.

Each control circuit 22 controls the ON period Ton1 of the current I based on the instructions from the MICOM 31 as described above, and performs a feedback control on the peak value Ip of the current I based on the output of the corresponding error amplifier 23.

Meanwhile, even though the ON period Ton1 of each current I is controlled based on the instructions from the MICOM 31, the output ratio of the solid state light emitting element groups Lr and Lg may be deviated from the target output ratio if the peak value Ipr of the current Ir and the peak value Ipg of the current Ig are relatively different from each other. In such case, the deviation duv of the mixed color light of the lights irradiated by the light emitting element groups L becomes larger.

However, in this embodiment, the lighting control units 2*r* and 2*g* perform the feedback control on the peak values Ipr and Ipg of the currents Ir and Ig by using the average value (average detection voltage VIpa) of the peak values Ipr and Ipg as the detection result, respectively. That is, since it is controlled such that the average value of the peak values Ipr and Ipg becomes equal to the reference voltage Vref, the relative difference between the peak values Ipr and Ipg is reduced. Accordingly, the deviation duv of the mixed color light of the lights irradiated by the light emitting element groups L is reduced and the color reproducibility can be improved.

In addition, since the average detection voltage VIpa is used as the detection result to perform the feedback controls on the respective peak values Ipr and Ipg of the currents Ir and Ig, the deviation of both the peak values Ipr and Ipg of the currents Ir and Ig from the reference voltage Vref becomes uniform.

Further, in this embodiment, if the reference voltage Vref outputted from the output control unit 4 is varied, the peak value Ip of each current I is varied by the feedback control. That is, merely by varying the reference voltage Vref, the output of the mixed color light of the lights irradiated by the light emitting element groups L can be varied while maintaining the chromaticity thereof. Thus, the output of the mixed color light can be easily adjusted.

Further, although the error amplifiers 23*r* and 23*g* are provided in the lighting control units 2*r* and 2*g* in this embodiment, one error amplifier 23 may be provided to output the difference between the average detection voltage VIpa and the reference voltage Vref to the control circuits 22*r* and 22*g*. Thus, it is possible to reduce the number of error amplifiers 23, and to simplify the configuration.

(Fifth Embodiment)

Figure 10:
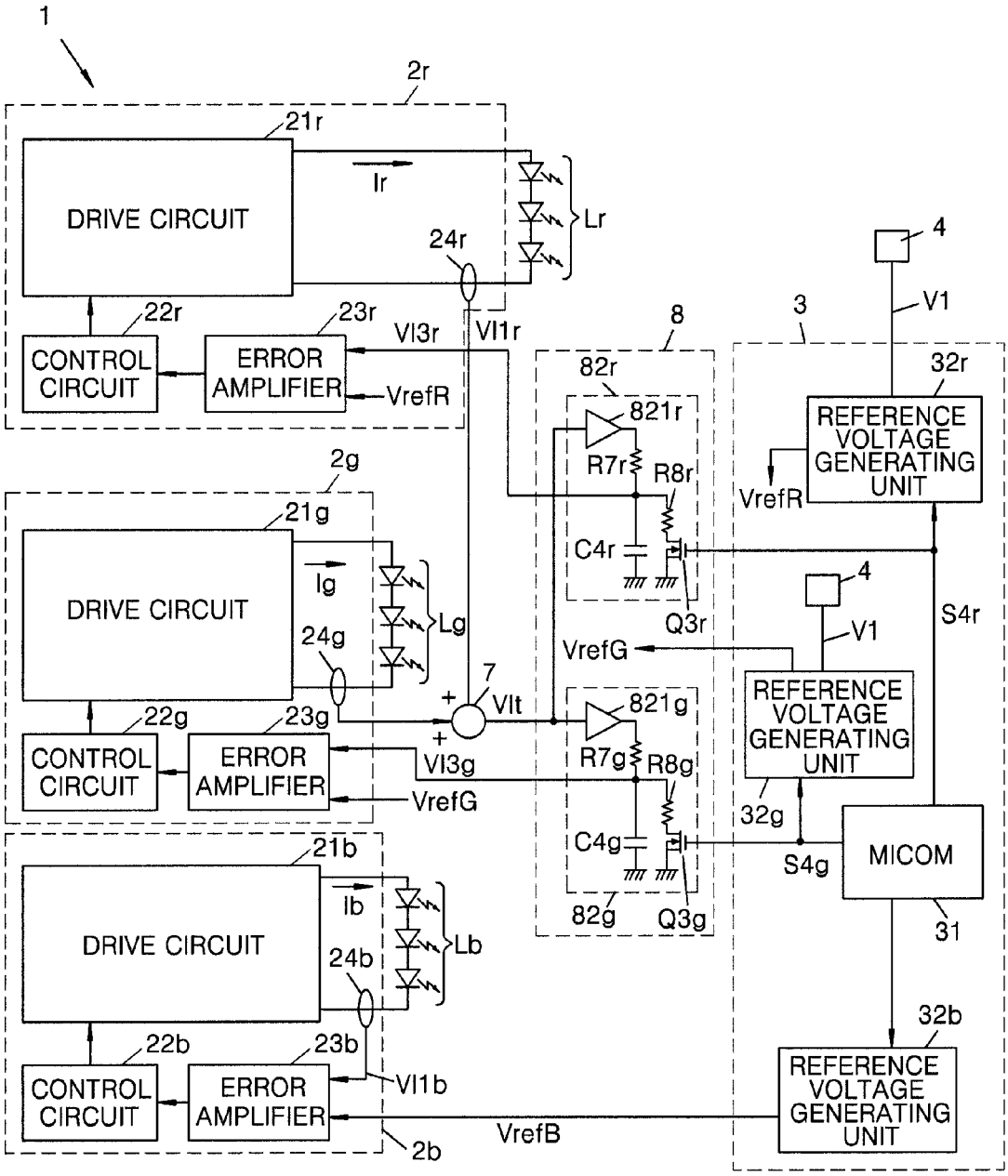
FIG. 10 illustrates a block diagram of a lighting device in accordance with a fifth embodiment of the present invention.

FIG. 10 illustrates a block diagram of a lighting device 1 in accordance with a fifth embodiment of the present invention. Like reference numerals will be given to like parts common to the fourth embodiment, and a redundant description thereof will be omitted.

The lighting device 1 of this embodiment performs an amplitude dimming in which lighting control units 2*r*, 2*g* and 2*b* supply DC currents (steady-state currents) to solid state light emitting element groups Lr, Lg and Lb and control amplitudes of the currents to control outputs from the solid state light emitting element groups Lr, Lg and Lb, respectively. Further, the lighting control units 2*r*, 2*g* and 2*b* control such that an output ratio of the solid state light emitting element groups Lr, Lg and Lb becomes same as a target output ratio.

A color ratio setting unit 3 of this embodiment includes a MICOM 31, and the reference voltage generating units 32*r*, 32*g* and 32*b*.

Reference voltage generating units 32*r* and 32*g* generate reference voltages VrefR and VrefG based on control signals S4*r* and S4*g* outputted from the MICOM 31 by using, as a source voltage, a control voltage V1 outputted from the output control unit 4.

As shown in (a) and (b) of FIG. 8, each of the control signals S4*r* and S4*g* is a PWM signal, and the MICOM 31 determines the ON periods Ton4*r* and Ton4*g* of the control signals S4*r* and S4*g* based on the target output ratio. Specifically, the MICOM 31 determines the ON periods Ton4*r* and Ton4*g* such that the period T4 corresponds to the total output of the light emitting element groups Lr and Lg, and the ratios of the respective ON periods Ton4*r* and Ton4*g* to the period T4 (i.e., Ton4*r*/T4 and Ton4*g*/T4) become equal to the ratios of the respective outputs of the solid state light emitting element groups Lr and Lg to the total output of the solid state light emitting element groups Lr and Lg (i.e., Lr/(Lr+Lg) and Lg/(Lr+Lg)). Thus, Ton4*r*+Ton4*g*=T4 is established.

Then, the reference voltage generating units 32*r* and 32*g* generate the reference voltages VrefR and VrefG obtained by smoothing (dividing) the control voltage V1 by using the control signals S4*r* and S4*g*. The reference voltages VrefR and VrefG are given by V1×Ton4*r*/T4 and V1×Ton4*g*/T4, respectively.

Further, the reference voltage generating units 32*r* and 32*g* output the generated reference voltages VrefR and VrefG to the error amplifiers 23*r* and 23*g*. That is, the control voltage V1 corresponds to the total output of the light emitting element groups Lr and Lg, and the reference voltages VrefR and VrefG are generated by dividing the control voltage V1 based on the target output ratio of the solid state light emitting element groups Lr and Lg. Thus, the ratio of the reference voltages VrefR and VrefG is equal to the target output ratio of the solid state light emitting element groups Lr and Lg.

Further, a reference voltage generating unit 32*b* generates a reference voltage VrefB based on the instructions from the MICOM 31 such that the ratio of the reference voltages VrefR, VrefG and VrefB becomes equal to the target output ratio of the solid state light emitting element groups Lr, Lg and Lb, and outputs the reference voltage VrefB to the error amplifier 23*b*.

The reference voltages VrefR, VrefG and VrefB become target amplitudes of the currents Ir, Ig and Ib being supplied to the solid state light emitting element groups Lr, Lg and Lb.

Further, a dividing unit 8 of this embodiment includes smoothing units 82*r* and 82*g*, and each smoothing unit is connected to the output terminal of an adder 7. An input terminal of the adder 7 is connected to current detection units 24*r* and 24*g*, and detection voltages VI1*r* and VI1*g* detected by the current detection units 24*r* and 24*g* are inputted to the input terminal of the adder 7. The detection voltages VI1*r* and VI1*g* correspond to the amplitude of the currents Ir and Ig. In this embodiment, the current detection unit 24*r* corresponds to the first detection unit described in the claims, and the current detection unit 24*g* corresponds to the second detection unit described in the claims. Further, the adder 7 generates a total detection voltage VIt obtained by adding the detection voltages VI1*r* and VI1*g*, and outputs the total detection voltage VIt to the smoothing units 82*r* and 82*g*.

Each smoothing unit 82 includes a follower 821, resistors R7 and R8, a capacitor C4, and a switching element Q3. The follower 821, the resistors R7 and R8 and the switching element Q3 are connected in series, and the capacitor C4 is connected in parallel to a series circuit of the resistor R8 and the switching element Q3. An input terminal of the follower 821 is connected to the adder 7, and the total detection voltage VIt is applied thereto. Further, the switching element Q3 is formed of an n-channel MOSFET and interposed between the resistor R8 and the ground. A gate of the switching element Q3 is connected to the MICOM 31, and the switching element Q3 is turned on/off based on the control signal S4 to make an electrical connection and disconnection between the resistor R8 and the ground. Accordingly, a smoothed voltage VI3, which is obtained by smoothing (dividing) the total detection voltage VIt based on the ON period Ton4 in the period T4 of the control signal S4, is generated across the capacitor C4. That is, the smoothing unit 82*r* generates the smoothed voltage VI3*r* (=VIt×Ton4*r*/T4), and the smoothing unit 82*g* generates the smoothed voltage VI3*g* (=VIt×Ton4*g*/T4).

Further, the control signal S4 outputted from the MICOM 31 to the switching element Q4 is identical to the above-described control signal S1 outputted from the MICOM to the reference voltage generating unit 32. That is, the smoothing units 82*r* and 82*g* use the control signals S4*r* and S4*g* and generate the smoothed voltages VI3*r* and VI3*g* for the lighting control units 2r and 2g, respectively, by dividing the total detection voltage VIt based on the target output ratio. Thus, the ratio of the smoothed voltages VI3r to VI3g is equal to the target output ratio of the solid state light emitting element groups Lr to Lg. Then, the smoothing units 82r and 82g output the generated smoothed voltages VI3r and VI3g to error amplifiers 23r and 23g, respectively. The smoothed voltages VI3r and VI3g correspond to the division detection result described in the claims.

The error amplifiers 23r and 23g output a difference between the reference voltage VrefR and the smoothed voltage VI3r and a difference between the reference voltage VrefG and the smoothed voltage VI3g to control circuits 22r and 22g, respectively. Further, an error amplifier 23b outputs a difference between the reference voltage VrefB and the detection voltage VI1b to a control circuit 22b.

The control circuits 22r and 22g perform feedback controls on the amplitudes of the currents Ir and Ig such that the smoothed voltages VI3r and VI3g become equal to the reference voltages VrefR and VrefG, respectively. Further, the control circuit 22b performs a feedback control of the amplitude of the current Ib such that the detection voltage VI1b becomes equal to the reference voltage VrefB.

As described above, in this embodiment, the feedback control is performed by using as the detection result the smoothed voltages VI3r and VI3g, which are obtained by dividing the total output (total detection voltage VIt) of the light emitting element groups Lr and Lg based on the target output ratio. The total detection voltage VIt includes errors in the detection voltages VI1r and VI1g with respect to the target values (reference voltages VrefR and VrefG), and the errors are also divided due to the division of the total detection voltage VIt. That is, the smoothed voltages VI3r and VI3g include values obtained by averaging the errors of the detection voltages VI1r and VI1g with respect to the target values (reference voltages VrefR and VrefG). Further, by performing the feedback control such that the smoothed voltages VI3r and VI3g become equal to the reference voltages VrefR and VrefG, the deviation of the ratio of the detection voltages VI1r to VI1g from the ratio of the reference voltages VrefR to VrefG is reduced. Thus, the deviation duv of the mixed color light of the lights irradiated by the light emitting element groups L is reduced and the color reproducibility can be improved.

In addition, by performing the feedback control by using the smoothed voltages VI3r and VI3g, the deviation of the detection voltages VI1r and VI1g from the respective reference voltages VrefR and VrefG become uniform.

In addition, in this embodiment, merely by varying the control voltage V1 outputted from the output control unit 4, the values of the reference voltages VrefR, VrefG and VrefB can be varied while maintaining the ratio thereof (target output ratio). That is, the output of the mixed color light of the lights irradiated by the light emitting element groups L can be varied while maintaining the chromaticity thereof by varying the control voltage V1 alone. Thus, the output of the mixed color light can be easily adjusted.

(Sixth Embodiment)

Figure 11:
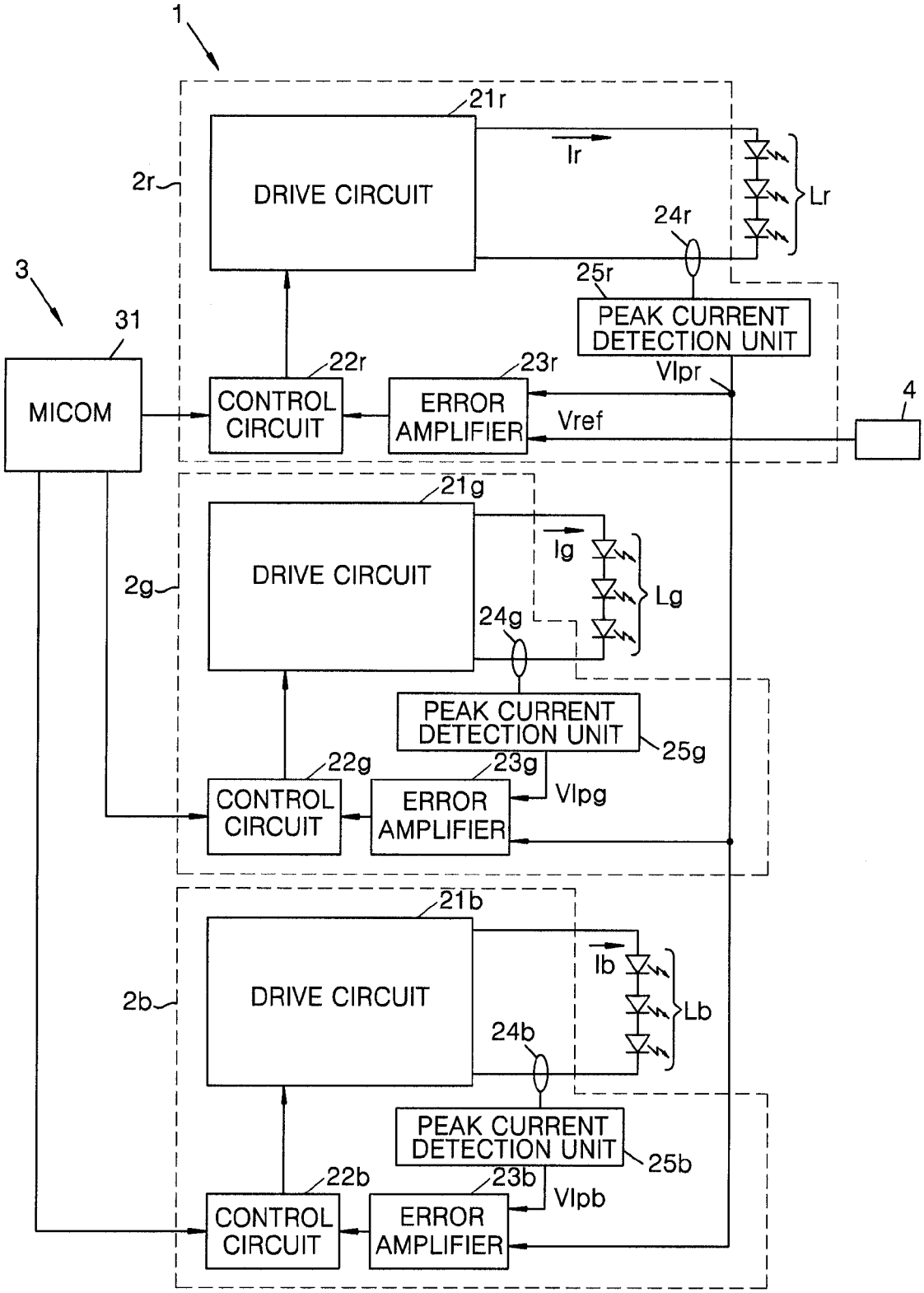
FIG. 11 illustrates a block diagram of a lighting device in accordance with a sixth embodiment of the present invention.

FIG. 11 illustrates a block diagram of a lighting device 1 in accordance with a sixth embodiment of the present invention.

The lighting device 1 of this embodiment turns on a solid state light emitting element group Lr irradiating a red light, a solid state light emitting element group Lg irradiating a green light, and a solid state light emitting element group Lb irradiating a blue light at a predetermined output ratio to irradiate a mixed color light thereof. The solid state light emitting element groups Lr, Lg and Lb, each including an array of three solid state light emitting elements (light emitting diodes), are configured to irradiate the red light, the green light and the blue light, respectively. In addition, if it is not necessary to separately identify each of the solid state light emitting element group Lr, Lg and Lb, it is referred to as the solid state light emitting element group L. Although the solid state light emitting element group L of this embodiment includes an array of three solid state light emitting elements, it may include an array including a different number of solid state light emitting elements. Further, the solid state light emitting element group Lr corresponds to a first solid state light emitting element group described in the claims, and the solid state light emitting element groups Lg and Lb correspond to a second solid state light emitting element group described in the claims.

The lighting device 1 includes lighting control units 2r, 2g and 2b for controllably turning on and off the solid state light emitting element groups Lr, Lg and Lb, a color ratio setting unit 3 for setting a target output ratio of the solid state light emitting element groups Lr, Lg and Lb, and an output control unit 4. The lighting device 1 performs a burst dimming in which the lighting control units 2r, 2g and 2b control respective outputs from the solid state light emitting element groups Lr, Lg and Lb by supplying an intermittent current to each of the solid state light emitting element groups Lr, Lg and Lb and controlling an ON period thereof. Further, the output ratio of the solid state light emitting element groups Lr, Lg and Lb is controlled to be equal to the target output ratio under the control of the lighting control units 2r, 2g and 2b. Further, the lighting control units 2r, 2g and 2b have the same configuration. In the following description, "r (R)" is assigned to the end of a reference numeral of a component related to the lighting control unit 2r, "g (G)" is assigned to the end of a reference numeral of a component related to the lighting control unit 2g, and "b (B)" is assigned to the end of a reference numeral of a component related to the lighting control unit 2b. In addition, if it is not necessary to individually identify, the alphabet at the end will be omitted.

The color ratio setting unit 3 includes the microcomputer 31 (hereinafter simply referred to as MICOM 31). The target output ratio of the solid state light emitting element groups L has been set in the MICOM 31. Further, the MICOM 31 determines an ON period of a current I being supplied to the solid state light emitting element group L from each lighting control unit 2 on the basis of the target output ratio, and sends the instructions to each lighting control unit 2. Then, each lighting control unit 2 controls the current I such that the ON period of the current I corresponds to a value instructed by the MICOM 31 and supplies the controlled current I to each individual light emitting element group L.

Next, the specific configuration and control of the lighting control unit 2 will be described. The lighting control unit 2 includes a drive circuit 21, a control circuit 22, an error amplifier 23, a current detection unit 24, and a peak current detection unit 25.

The drive circuit 21 turns on the solid state light emitting element group L by supplying the current I to the solid state light emitting element group L.

The control circuit 22 controls the current I by controlling the drive circuit 21. As shown in (a) to (c) of FIG. 2, each of the currents Ir, Ig and Ib is configured as intermittent current repeating the ON and the OFF period. The control circuits 22r, 22g and 22b respectively control the ON periods Ton1r, Ton1g and Ton1b in the period T1 on the basis of the instructions from the MICOM 31.

The current detection unit 24 detects the current I being supplied from the drive circuit 21 to the solid state light emitting element group L, and outputs the detection result to the peak current detection unit 25.

The peak current detection unit 25 obtains an amplitude (hereafter referred to as peak value Ip) of the current I in the ON period Ton1 from the detection result of the current detection unit 24, generates a detection voltage VIp corresponding to the peak value Ip, and outputs the detection voltage VIp to the error amplifier 23.

The current detection unit 24*r* and the peak current detection unit 25*r* correspond to the first detection unit described in the claims.

Specifically, an input terminal of the error amplifier 23*r* provided in the lighting control unit 2*r* (first lighting control unit) is connected to the peak current detection unit 25*r* and the output control unit 4. The detection voltage VIpr outputted from the peak current detection unit 25*r* and a reference voltage Vref (first reference value) outputted from the output control unit 4 are applied to the input terminal of the error amplifier 23*r*. In addition, the reference voltage Vref corresponds to a target value of the detection voltage VIpr corresponding to the peak value Ipr of the current Ir. Further, the error amplifier 23*r* outputs a difference between the detection voltage VIpr and the reference voltage Vref to the control circuit 22*r*.

The control circuit 22*r* (first control circuit) controls the ON period Ton1*r* of the current Ir based on the instructions from the MICOM 31 as described above, and controls the drive circuit 21*r* (first drive circuit) based on the output of the error amplifier 23*r*, thereby performing a feedback control on the peak value Ipr of the current Ir.

Meanwhile, even though the ON period Ton1 of each current I is controlled based on the instructions from the MICOM 31, the output ratio of the solid state light emitting element groups L may be deviated from the target output ratio if respective peak values Ip of the currents I are relatively different from each other. In such case, the mixed color light of the lights irradiated by the solid state light emitting element groups L has a chromaticity different from a desired chromaticity.

However, in this embodiment, input terminals of the error amplifiers 23*g* and 23*b* provided in the lighting control units 2*g* and 2*b* (second lighting control unit) are connected to the peak current detection units 25*g* and 25*b*, respectively, and further connected to the peak current detection unit 25*r*. The detection voltages VIpg and VIpb outputted from the peak current detection units 25*g* and 25*b* and the detection voltage VIpr outputted from the peak current detection unit 25*r* are applied to the error amplifiers 23*g* and 23*b*. In other words, the detection voltage VIpr becomes a reference value (target value) of the detection voltages VIpg and VIpb corresponding to the peak values Ipg and Ipb of the currents Ig and Ib. Further, the error amplifiers 23*g* and 23*b* output a difference between the detection voltage VIpg and the detection voltage VIpr and a difference between the detection voltage VIpb and the detection voltage VIpr to the control circuits 22*g* and 22*b*, respectively.

The current detection units 24*g* and 24*b* and the peak current detection units 25*g* and 25*b* correspond to the second detection unit described in the claims, and the detection voltage VIpr corresponds to the second reference value described in the claims.

The control circuits 22*g* and 22*b* (second control circuit) control the ON periods Ton1*g* and Ton1*b* of the currents Ig and Ib based on the instructions from the MICOM 31 as described above, and performs feedback-controls on the drive circuits 21*g* and 21*b* (second drive circuit) based on the output of the error amplifiers 23*g* and 23*b*. That is, the control circuits 22*g* and 22*b* perform the feedback controls such that the peak values Ipg and Ipb of the currents Ig and Ib become equal to the peak value Ipr of the current Ir.

As described above, in this embodiment, based on the output from one (lighting control unit 2*r*) of the lighting control units 2, the feedback controls on the outputs from the other units (lighting control units 2*g* and 2*b*) are performed. Accordingly, since a relative difference between the peak values Ip is reduced, a deviation of the output ratio of the solid state light emitting element groups L from the target output ratio is reduced. Thus, the color reproducibility of the mixed color light of the lights irradiated by the light emitting element groups L can be improved.

Further, in this embodiment, the outputs from the lighting control units 2*g* and 2*b* are feedback-controlled on the basis of the output from the lighting control unit 2*r*, but the outputs from the lighting control units 2*r* and 2*b* may be feedback-controlled on the basis of the output from the lighting control unit 2*g*, and the outputs from the lighting control units 2*r* and 2*g* may be feedback-controlled on the basis of the output from the lighting control unit 2*b*.

In addition, in this embodiment, if the reference voltage Vref outputted by the output control unit 4 is varied, the reference voltages VrefR, VrefG and VrefB are varied while maintaining the ratio thereof. That is, merely by varying the reference voltage Vref, the output of the mixed color light of the lights irradiated by the light emitting element groups L can be varied while maintaining the color temperature thereof. Thus, the output of the mixed color light can be easily adjusted.

Further, although the mixed color light is irradiated by the solid state light emitting element group Lr irradiating the red light, the solid state light emitting element group Lg irradiating the green light and the solid state light emitting element group Lb irradiating the blue light in this embodiment, the solid state light emitting element groups L irradiating lights of other colors may be used. For example, the solid state light emitting element group L irradiating a white light with a high color temperature instead of the blue light may be used. Further, although the solid state light emitting element groups L of three colors are used to irradiate the mixed color light, it may be configured to irradiate the mixed color light of the lights from the light emitting element groups L of a different number of colors.

(Seventh Embodiment)

Figure 12:
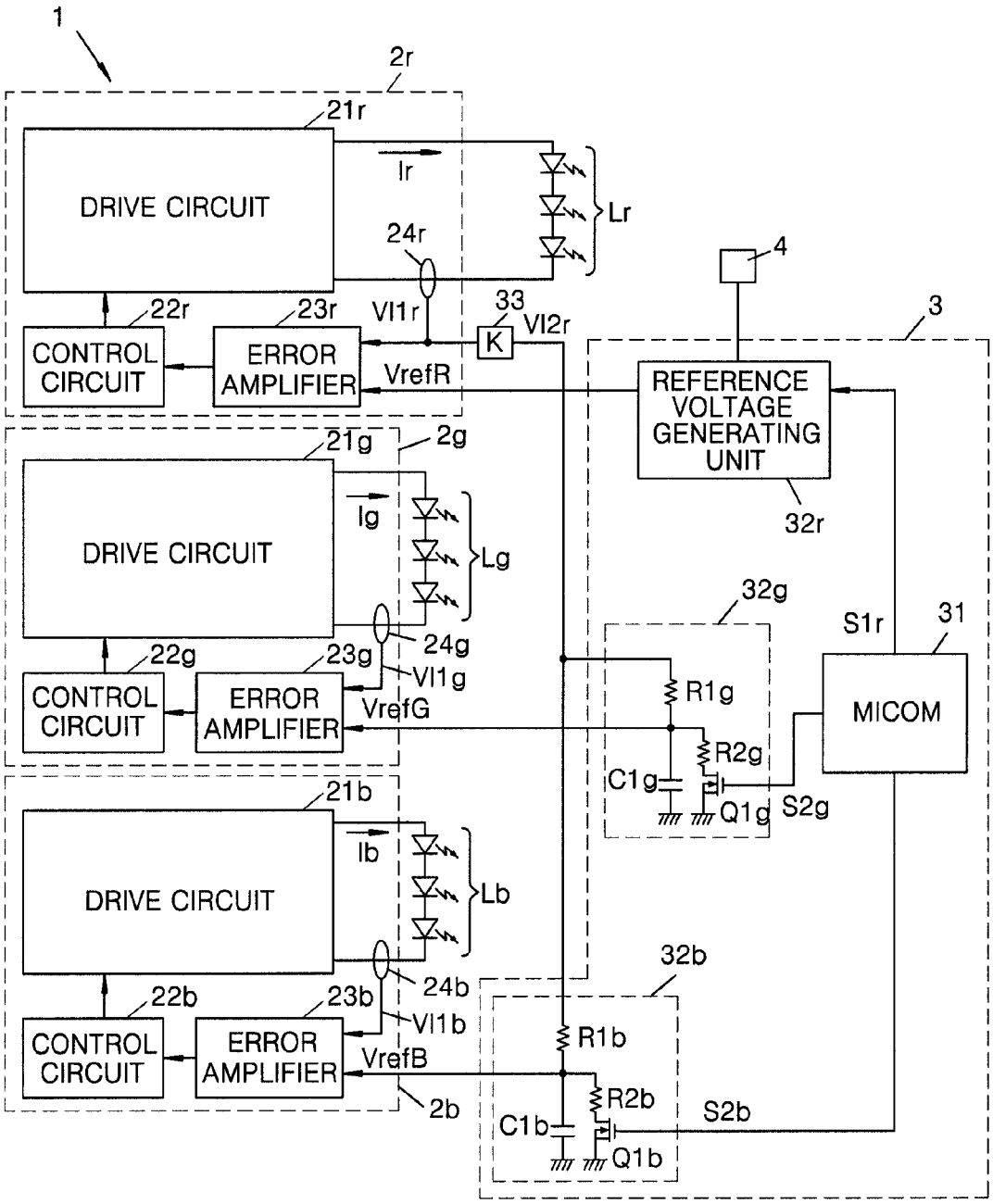
FIG. 12 illustrates a block diagram of a lighting device in accordance with a seventh embodiment of the present invention.

FIG. 12 illustrates a block diagram of a lighting device 1 in accordance with a seventh embodiment of the present invention. Like reference numerals will be given to like parts common to the sixth embodiment, and a redundant description thereof will be omitted.

The lighting device 1 of this embodiment performs an amplitude dimming in which lighting control units 2*r*, 2*g* and 2*b* supply DC currents (steady-state currents) to solid state light emitting element groups Lr, Lg and Lb and control amplitudes of the currents to control outputs from the solid state light emitting element groups Lr, Lg and Lb, respectively. Further, the lighting control units 2*r*, 2*g* and 2*b* control such that an output ratio of the solid state light emitting element groups Lr, Lg and Lb becomes same as a target output ratio.

A color ratio setting unit 3 of this embodiment includes a MICOM 31, and reference voltage generating units 32*r*, 32*g* and 32*b*.

The reference voltage generating unit 32*r* generates a reference voltage VrefR based on a control signal S1*r* outputted from the MICOM 31 by using, as a source voltage, a control voltage V1 outputted from the output control unit 4. As shown in (a) of FIG. 13, the control signal S1*r* is a PWM signal, and the MICOM 31 determines an ON period Ton2*r* of the control signal S1*r* based on a target output of the solid state light emitting element group Lr. The reference voltage VrefR is V1×Ton2*r*/T2 (i.e., VrefR=V1×Ton2*r*/T2).

Further, the reference voltage generating unit 32*r* outputs the reference voltage VrefR, which is obtained by smoothing (dividing) the control voltage V1 based on the control signal S1*r*, to the error amplifier 23*r*. The reference voltage VrefR corresponds to the first reference value described in the claims, and a target amplitude of the current Ir being supplied to the solid state light emitting element group Lr.

Further, each current detection unit 24 detects the amplitude of the current I being supplied to the solid state light emitting element group L, and outputs the detection voltage VI1 corresponding to the amplitude of the current I to the error amplifier 23. Further, in this embodiment, the current detection unit 24*r* corresponds to the first detection unit, and the current detection units 24*g* and 24*b* correspond to the second detection unit.

Therefore, an input terminal of the error amplifier 23*r* is connected to the reference voltage generating unit 32*r* and the current detection unit 24*r*. The error amplifier 23*r* outputs a difference between the reference voltage VrefR and the detection voltage VI1*r* to the control circuit 22*r*.

The control circuit 22*r* performs a feedback control on the amplitude of the current Ir based on the output of the error amplifier 23*r* such that the detection voltage VI1*r* becomes equal to the reference voltage VrefR.

In addition, in this embodiment, an output terminal of the current detection unit 24*r* is connected to the reference voltage generating units 32*g* and 32*b* through an amplifier 33. The amplifier 33 generates an amplification voltage VI2*r* obtained by amplifying the detection voltage VIr outputted from the current detection unit 24*r* by K times (K=real number greater than 1) and outputs the amplification voltage VI2*r* to the reference voltage generating units 32*g* and 32*b*.

The reference voltage generating unit 32*g* includes resistors R1*g* and R2*g*, a switching element Q1*g* and a capacitor C1*g*. The resistors R1*g* and R2*g* and the switching element Q1*g* are connected in series, and the capacitor C1*g* is connected in parallel to a series circuit of the resistor R2*g* and the switching element Q1*g*. An output terminal of the amplifier 33 is connected to the error amplifier 23*g* through the resistor R1*g* and connected to the error amplifier 23*b* through the resistor R1*b*. Further, the switching element Q1*g* is formed of an n-channel MOSFET and interposed between the resistor R2*g* and the ground. A gate of the switching element Q1*g* is connected to the MICOM 31, and the switching element Q1*g* is turned on and off based on the control signal S2*g* to make an electrical connection and disconnection between the resistor R2*g* and the ground. Accordingly, a reference voltage VrefG, which is obtained by smoothing (dividing) the amplification voltage VI2*r* based on an ON period Ton3*g* of the control signal S2*g*, is generated across the capacitor C1*g*. Further, since the reference voltage generating unit 32*b* has the same configuration as the reference voltage generating unit 32*g*, a description thereof will be omitted.

Figure 13:
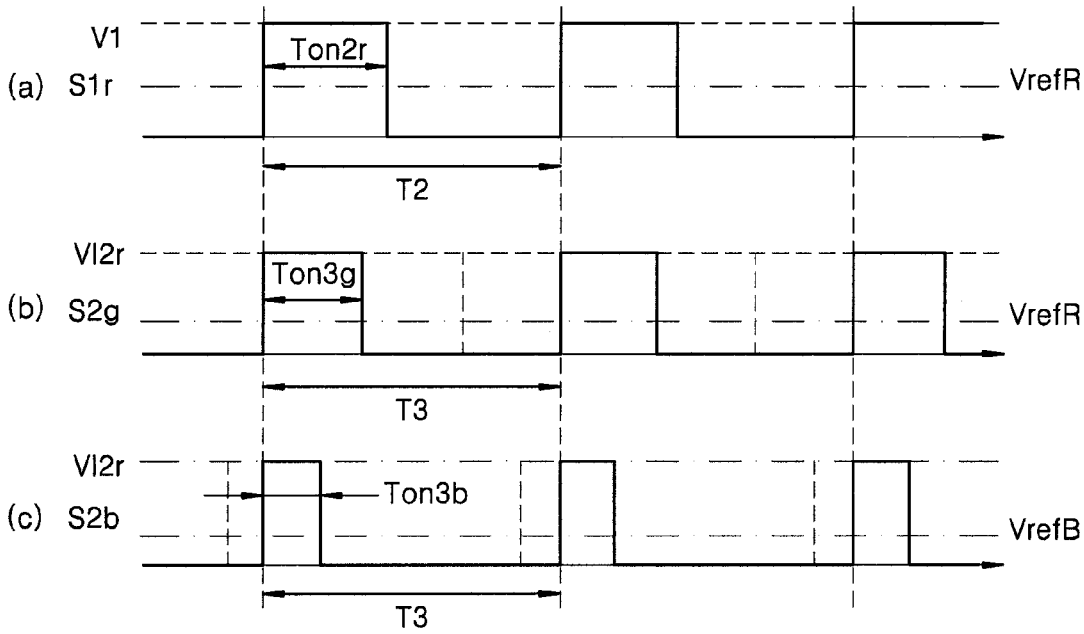
FIG. 13 illustrates waveform diagrams (a) to (c) of control signals.

Each of the control signals S2*g* and S2*b* outputted from the MICOM 31 to the switching elements Q1*g* and Q1*b* is a PWM signal as shown in (b) and (c) of FIG. 13. The ON periods Ton3*g* and Ton3*b* in a period T3 of the control signals S2*g* and S2*b* are determined based on the target output ratio. Specifically, the ON periods Ton3*g* and Ton3*b* are determined such that the target output ratios of the respective solid state light emitting element groups Lg and Lb to the solid state light emitting element group Lr (i.e., Lg/Lr and Lb/Lr) becomes equal to the respective ON periods Ton3*g* and Ton3*b* to the period T3 (i.e., Ton3*g*/T3 and Ton3*b*/T3) in the control signals S2*g* and S2*b*. Accordingly, the reference voltages VrefG and VrefB generated by the reference voltage generating units 32*g* and 32*b* are given by VI2r×Ton3*g*/T3 and VI2*r*×Ton3*b*/T3, respectively. The reference voltages VrefG and VrefB correspond to the second reference values described in the claims, which are target amplitudes of the respective currents Ig and Ib being supplied to the solid state light emitting element groups Lg and Lb.

Then, the error amplifiers 23*g* and 23*b* output a difference between the reference voltage VrefG and the detection voltage VI1*g* and a difference between the reference voltage VrefB and the detection voltage VI1*b* to the control circuits 22*g* and 22*b*, respectively.

The control circuits 22*g* and 22*b* perform the feedback controls on the amplitudes of the currents Ig and Ib based on the outputs of the error amplifiers 23*g* and 23*b* such that the detection voltages VI1*g* and VI1*b* are equal to the reference voltages VrefG and VrefB, respectively. Further, in this embodiment, as shown in (a) to (c) of FIG. 13, the period T2 of the control signal S1*r* is the same as the period T3 of the control signals S2*g* and S2*b*.

In the conventional case, as shown in (a) to (c) of FIG. 5, the control voltage V1 is smoothed (divided) based on control signals S1*r*, S1*g* and S1*b* to generate each of reference voltages VrefR, VrefG and VrefB, and it is controlled such that a ratio of the generated reference voltages VrefR, VrefG and VrefB becomes a target output ratio. However, an amplitude of the current I may be deviated from the target value due to an offset of the error amplifier 23 or variations in parts of the drive circuit 21. Thus, it becomes difficult to improve color reproducibility of a mixed color light of the lights from the light emitting element groups L since it is required to adjust an output of each individual light emitting element group L.

On the other hand, in this embodiment, based on the output of the lighting control unit 2*r*, the reference voltages VrefG and VrefB of the lighting control units 2*g* and 2*b* are generated, and the feedback controls on the currents Ig and Ib are performed. Accordingly, even if the amplitude of the current Ir outputted from the lighting control unit 2*r* is varied from the target value (reference voltage VrefR), the reference voltages VrefG and VrefB are generated in consideration of such variation. Accordingly, the amplitudes of the currents Ig and Ib are varied in the same way as the current Ir, and thus the deviation of the output ratio of the solid state light emitting element groups L from the target output ratio is reduced. Thus, the color reproducibility of the mixed color light of the lights irradiated by the light emitting element groups L can be improved.

Further, in this embodiment, if the ON period Ton2*r* of the control signal S1*r* outputted from the MICOM 31 to the reference voltage generating unit 32*r* is varied, the reference voltage VrefR is varied. That is, the amplitude of the current I can be varied while maintaining the ratio of the reference voltages VrefR, VrefG and VrefB. Accordingly, the output of the mixed color light of the lights irradiated by the light emitting element groups L can be varied while maintaining the chromaticity thereof by varying the ON period Ton2*r* alone. Thus, the output of the mixed color light can be easily adjusted.

Further, in this embodiment, the amplifier 33 is used to generate the amplification voltage VI2*r* by amplifying the detection voltage VI1*r* by K times, and the reference voltages VrefG and VrefB are generated by smoothing the amplification voltage VI2*r*. Therefore, as represented by dashed lines in (b) and (c) of FIG. 13, by increasing the ON periods Ton3*g* and Ton3*b*, the reference voltages VrefG and VrefB can be made greater than the detection voltage VI1*r*, and the outputs from the solid state light emitting element group Lg and Lb can be made greater than the output from the solid state light emitting element group Lr. Further, if the target output from the solid state light emitting element group Lr is always the greatest, the amplifier 33 may be omitted and it may be configured to generate the reference voltages VrefG and VrefB by smoothing the detection voltage VI1*r*.

Figure 14:
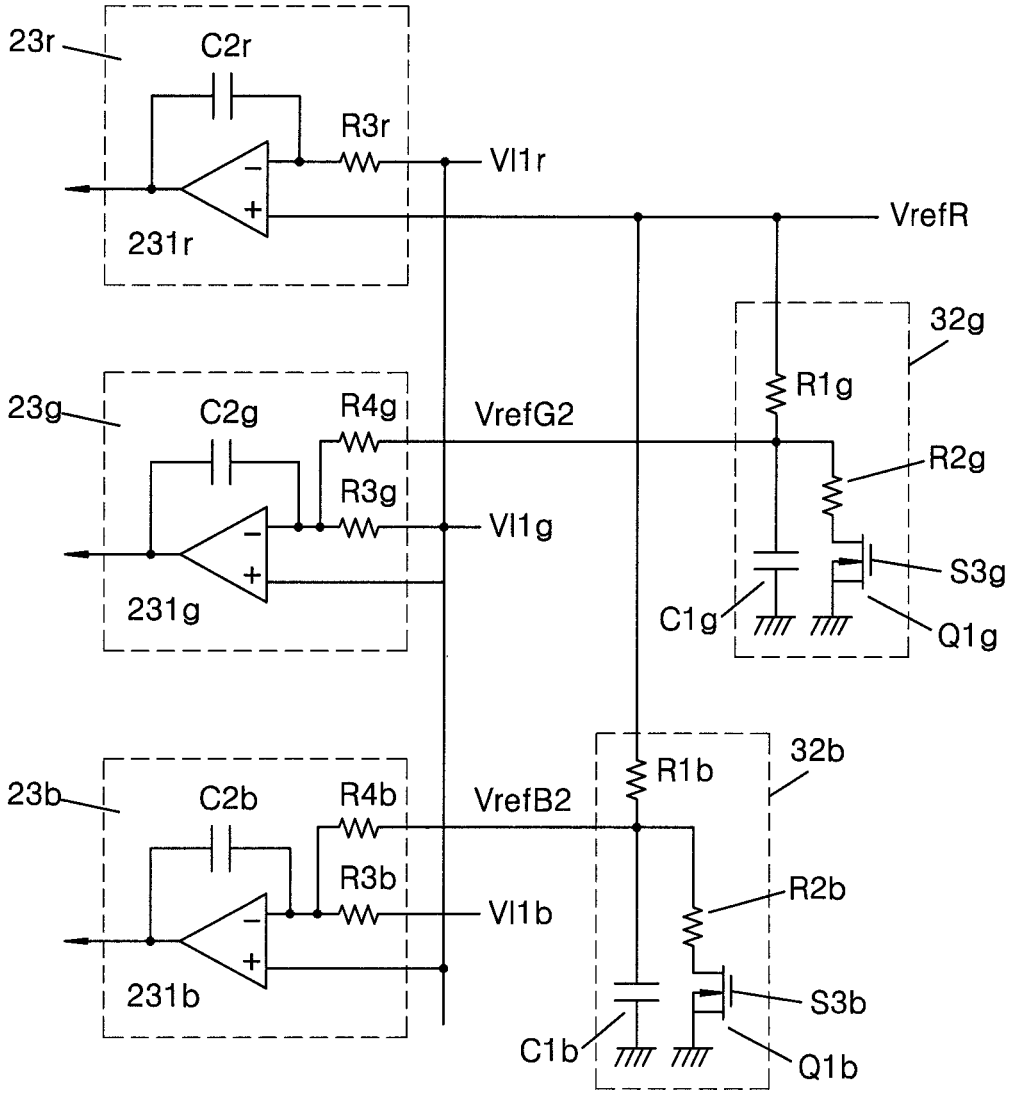
FIG. 14 is a circuit diagram showing another configuration of an error amplifier.

Further, if the target output from the solid state light emitting element group Lr is always the greatest, the error amplifier 23 may be configured as shown in FIG. 14.

The error amplifier 23*r* includes an operational amplifier 231*r*, a capacitor C2*r* and a resistor R3*r*. In the operational amplifier 231*r*, the reference voltage VrefR is applied to its non-inverting input terminal, and the detection voltage VI1*r* is applied to its inverting input terminal through the resistor R3*r*. Further, the capacitor C2*r* is inserted between the inverting input terminal and the output terminal. Further, the control circuit 22*r* performs the feedback control on the amplitude of the current Ir based on the output of the operational amplifier 231*r* such that the detection voltage VI1*r* becomes equal to the reference voltage VrefR.

Further, the error amplifier 23*g* includes an operational amplifier 231*g*, a capacitor C2*g* and resistors R3*g* and R4*g*. In the operational amplifier 231*g*, the detection voltage VI1*r* is applied to its non-inverting input terminal, and a voltage obtained by adding the detection voltage VI1*g* applied through the resistor R3*g* and a reference voltage VrefG2 applied through the resistor R4*g* is applied to its inverting input terminal. Further, since the error amplifier 23*b* has the same configuration as the error amplifier 23*g*, a description thereof will be omitted.

The reference voltage generating unit 32*g* uses the reference voltage VrefR as a source voltage and generates the reference voltage VrefG2 obtained by smoothing the reference voltage VrefR based on the control signal S3*g* outputted from the MICOM 31.

A control signal S3*g* is a PWM signal, and the on-duty is determined on the basis of the target output ratio. Specifically, the on-duty of the control signal S3*g* is determined to be a difference between the target output from the solid state light emitting element group Lr and the target output from the solid state light emitting element group Lg with respect to the target output from the solid state light emitting element group Lr. If the target outputs from the solid state light emitting element groups Lr and Lg are VrefR and VrefG, "difference between the target output from the solid state light emitting element group Lr and the target output from the solid state light emitting element group Lg with respect to the target output from the solid state light emitting element group Lr" is equivalent to (1−VrefG/VrefR). Accordingly, the reference voltage VrefG2 generated by the reference voltage generating unit 32*g* becomes VrefR×(1−VrefG/VrefR).

Then, the control circuit 22*g* performs the feedback control such that the detection voltage VI1*r* becomes equal to a sum of the detection voltage VI1*g* and the reference voltage VrefG2. That is, equivalently, the feedback control on the amplitude of the current Ig is performed based on a reference value obtained by subtracting the reference voltage VrefG2, which is the target output difference, from the output (detection voltage VI1*r*) from the lighting control unit 2*r*.

Thus, since the feedback controls on the amplitudes of the currents Ig and Ib are performed based on the amplitude of the current Ir, the same effect as described above can be obtained, and the deviation of the output ratio of the solid state light emitting element groups L from the target output ratio is reduced. Therefore, the color reproducibility of the mixed color light of the lights irradiated by the light emitting element groups L can be improved.

(Eighth Embodiment)

Figure 15:
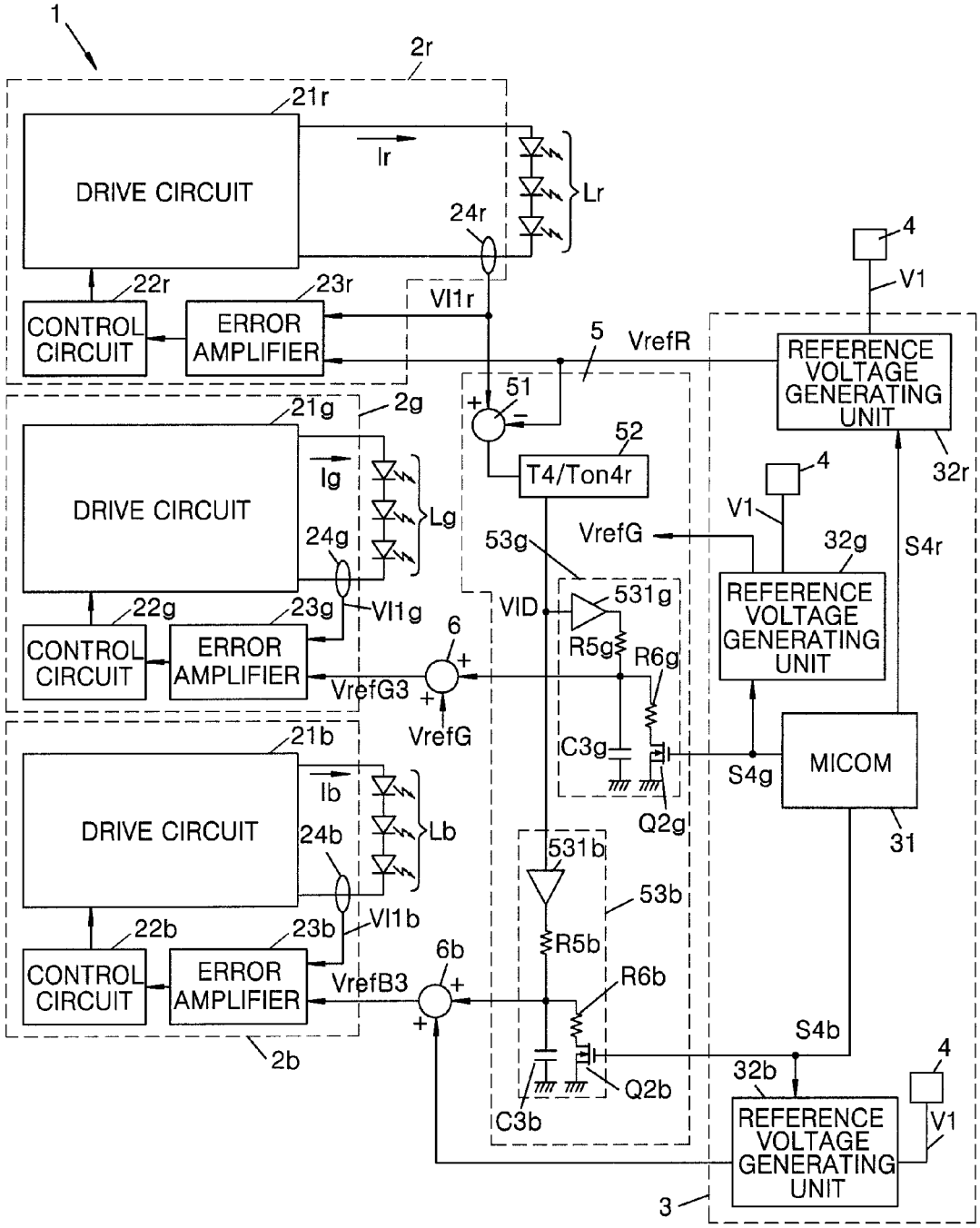
FIG. 15 illustrates a block diagram of a lighting device in accordance with an eighth embodiment of the present invention.

FIG. 15 illustrates a block diagram of a lighting device 1 in accordance with an eighth embodiment of the present invention. Like reference numerals will be given to like parts common to the seventh embodiment, and a redundant description thereof will be omitted.

The lighting device 1 of this embodiment performs an amplitude dimming in which lighting control units 2*r*, 2*g* and 2*b* supply DC currents to solid state light emitting element groups Lr, Lg and Lb and control amplitudes thereof to control outputs from the solid state light emitting element groups Lr, Lg and Lb, respectively. Further, the lighting control units 2*r*, 2*g* and 2*b* control such that the output ratio of the solid state light emitting element groups Lr, Lg and Lb becomes same as the target output ratio.

The lighting device 1 includes the lighting control units 2*r*, 2*g* and 2*b*, a color ratio setting unit 3, an output control unit 4, an error calculating unit 5, and adders 6*g* and 6*b*.

Reference voltage generating units 32 generate reference voltages VrefR, VrefG and VrefB based on the control signals S4*r*, S4*g* and S4*b* outputted from the MICOM 31 by using, as a source voltage, the control voltage V1 outputted from the output control unit 4.

Figure 16:
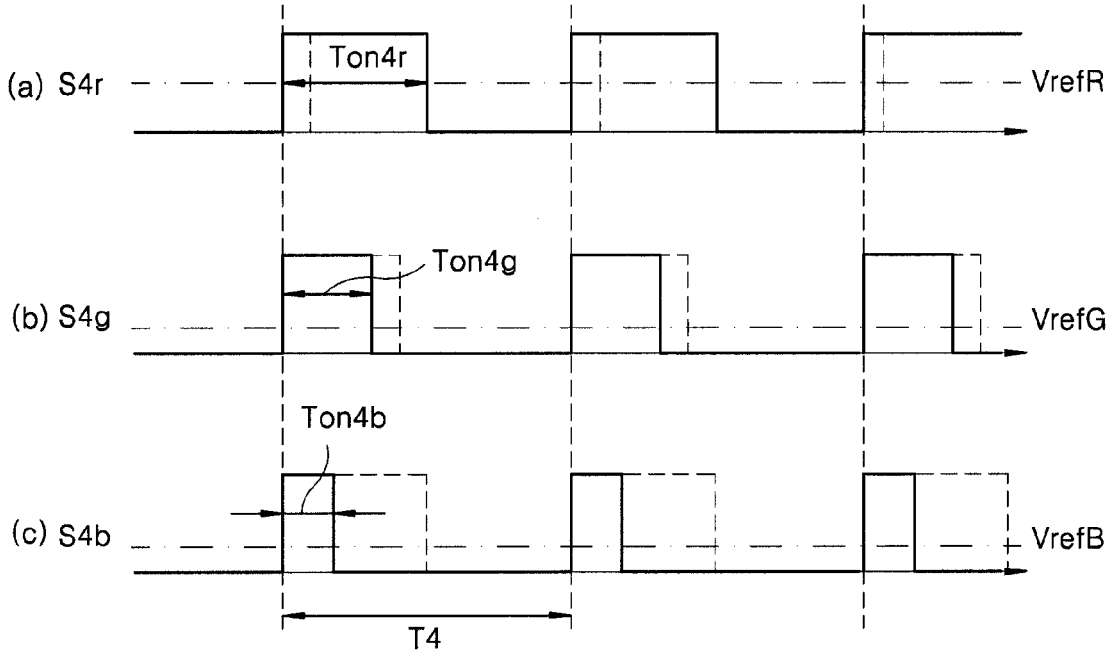
FIG. 16 illustrates waveform diagrams (a) to (c) of control signals.

As shown in (a) to (c) of FIG. 16, each of the control signals S4*r*, S4*g* and S4*b* is a PWM signal, and the MICOM 31 determines respective ON periods Ton4*r*, Ton4*g* and Ton4*b* of the control signals S4*r*, S4*g* and S4*b* based on the target output ratio. Specifically, the MICOM 31 determines the ON periods Ton4*r*, Ton4*g* and Ton4*b* such that ratios of the respective ON periods Ton4*r*, Ton4*g* and Ton4*b* to the period T4 (i.e., Ton4*r*/T4, Ton4*g*/T4 and Ton4*b*/T4) become equal to ratios of the respective outputs from the solid state light emitting element groups Lr, Lg and Lb to the total output from the solid state light emitting element groups Lr, Lg and Lb (i.e., Lr/(Lr+Lg+Lb), Lg/(Lr+Lg+Lb) and Lb/(Lr+Lg+Lb)). That is, the period T4 corresponds to the total output from the solid state light emitting element groups L, and the MICOM 31 determines the ON periods Ton4*r*, Ton4*g* and Ton4*b* based on the target output ratio such that a sum of the ON periods Ton4*r*, Ton4*g* and Ton4*b* becomes equal to the period T4 (i.e., Ton4*r*+Ton4*g*+Ton4*b*=T4).

Then, the reference voltage generating units 32*r*, 32*g* and 32*b* generate the reference voltages VrefR, VrefG and VrefB obtained by smoothing (dividing) the control voltage V1 outputted from the output control unit 4 based on the control signals S4*r*, S4*g* and S4*b*. That is, the control voltage V1 corresponds to the total output from the light emitting element groups L, and the control voltage V1 is divided into the reference voltages VrefR, VrefG and VrefB on the basis of the target output ratio. Thus, the reference voltages VrefR, VrefG and VrefB are V1×Ton4*r*/T4, V1×Ton4*g*/T4, and V1×Ton4*b*/T4, respectively.

An error amplifier 23*r* outputs a difference between a detection voltage VI1*r* and the reference voltage VrefR to a control circuit 22*r*. The control circuit 22*r* performs a feedback control on an amplitude of a current Ir such that the detection voltage VIr becomes equal to the reference voltage VrefR.

An error may occur between the detection voltage VI1*r* and the reference voltage VrefR due to an offset of the error amplifier 23*r* or variations in parts of the drive circuit 21. In this embodiment, such error can be detected and the other reference voltages VrefG and VrefB can be corrected on the basis of the target output ratio.

The error calculating unit 5 includes a subtractor 51, an amplifier 52 and smoothing units 53*g* and 53*b*.

The subtractor 51 has an input terminal, which is connected to a current detection unit 24*r* and the reference voltage generating unit 32*r*, and outputs to the amplifier 52 a value obtained by subtracting the reference voltage VrefR from the detection voltage VI1*r*.

The amplifier 52 generates an error voltage VID obtained by amplifying an output from the subtractor 51 by (T4/Ton4*r*) times, and outputs the error voltage VID to the smoothing units 53*g* and 53*b*. Further, the error voltage VID corresponds to an error in the total current of the currents Ir, Ig and Ib.

The smoothing unit 53*g* includes a follower 531*g*, resistors R5*g* and R6*g*, a capacitor C3*g*, and a switching element Q2*g*. The follower 531*g*, the resistors R5*g* and R6*g* and the switching element Q2*g* are connected in series, and the capacitor C3*g* is connected in parallel to a series circuit of the resistor R6*g* and the switching element Q2*g*. The switching element Q2*g* is formed of an n-channel MOSFET and interposed between the resistor R6*g* and the ground. A gate of the switching element Q2*g* is connected to the MICOM 31, and the switching element Q2*g* is turned on and off based on the control signal S4*g* to make electrical connection and disconnection between the resistor R6*g* and the ground, thereby varying an error voltage VIDg generated across the capacitor C3*g*. Further, the control signal S4*g* outputted to the switching element Q2*g* is the same as the control signal S4*g* outputted to the reference voltage generating unit 32*g*. That is, the error voltage VIDg is obtained by dividing the error voltage VID based on the target output ratio, and the error voltage VIDg is VID×Ton4*g*/T4.

The adder 6*g* has an input terminal, which is connected to the reference voltage generating unit 32*g* and the smoothing unit 53*g*, and generates the reference voltage VrefG3 obtained by adding the reference voltage VrefG and the error voltage VIDg. Further, the adder 6 outputs the reference voltage VrefG3 to the error amplifier 23*g*. Then, a control circuit 22*g* performs a feedback control on an amplitude of the current Ig based on an output from the error amplifier 23*g* such that a detection voltage VI1*g* becomes equal to the reference voltage VrefG3. Further, since the smoothing unit 53*b* and the adder 6*b* have the same configuration as the smoothing unit 53*g* and the adder 6*g*, a description thereof will be omitted. Further, the reference voltages VrefG and VrefB correspond to the third reference values described in the claims, and the reference voltage VrefG3 and VrefB3 correspond to the second reference values described in the claims.

As described above, in this embodiment, the reference voltages VrefG3 and VrefB3 are generated by detecting the error between the detection voltage VI1*r* and the reference voltage VrefR and correcting the reference voltages VrefG and VrefB based on the detected error. Then, the feedback controls are performed based on the reference voltages VrefG3 and VrefB3. That is, the reference voltages VrefG3 and VrefB3 to which the output error from the lighting control unit 2*r* is applied is used as reference values to perform the respective feedback controls on the amplitudes of the currents Ig and Ib. Accordingly, the amplitudes of the currents Ig and Ib are varied in the same way as the error in the amplitude of the current Ir, and thus the deviation of the output ratio of the solid state light emitting element groups L from the target output ratio is reduced. Thus, the color reproducibility of the mixed color light irradiated by the light emitting element groups L can be improved.

In addition, in this embodiment, if the control voltage V1 outputted from the output control unit 4 is varied, the reference voltages VrefR, VrefG and VrefB are varied while maintaining the ratio thereof. That is, merely by varying the control voltage V1, the output of the mixed color light of the lights irradiated by the light emitting element groups L can be varied while maintaining the color temperature thereof. Thus, the output of the mixed color light can be easily adjusted.

(Ninth Embodiment)

Figure 17A:
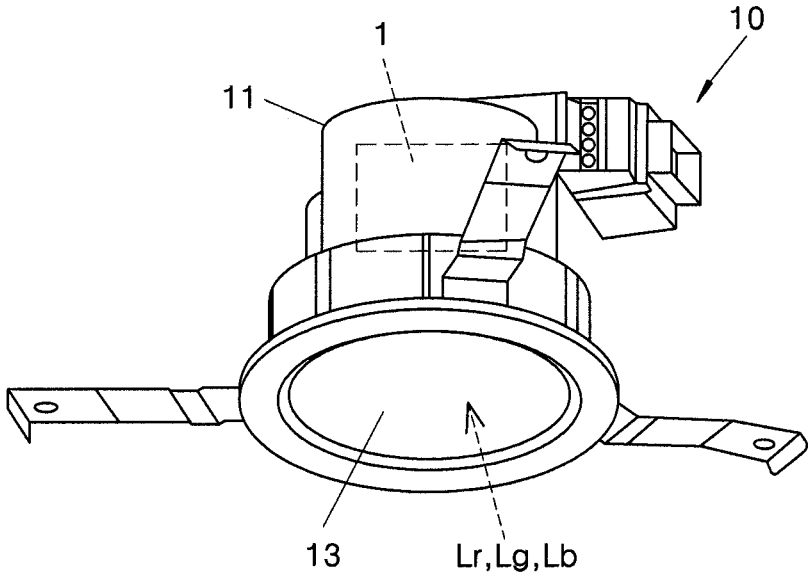
FIGS. 17A and 17B illustrate an appearance and a bottom view of an illumination apparatus in accordance with a ninth embodiment of the present invention.
Figure 17B:
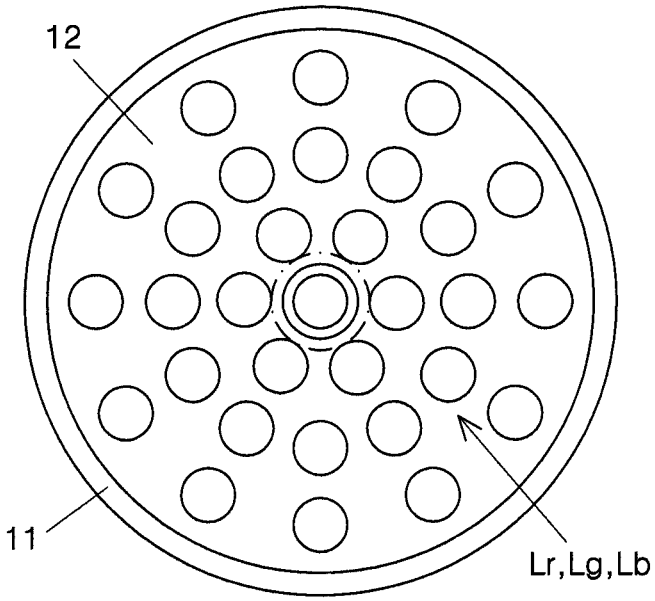

FIGS. 17A and 17B illustrate an appearance of an illumination apparatus 10 in accordance with a ninth embodiment of the present invention.

The illumination apparatus 10 of this embodiment is formed of a downlight. The lighting device 1 of any one of the first to eighth embodiments may be accommodated in a cylindrical apparatus main body 11. Further, as shown in FIG. 17B, solid state light emitting elements are mounted on a mounting substrate 12 provided inside the apparatus main body 11 to configure the solid state light emitting element groups Lr, Lg and Lb. The solid state light emitting element groups Lr, Lg and Lb are turned on and off under the control of the lighting device 1. Further, a light transmitting panel 13 is provided to cover an opening of the apparatus main body 11. The mixed color light of the lights from the solid state light emitting element groups Lr, Lg and Lb is irradiated to the outside through the light transmitting panel 13.

Since the illumination apparatus 10 of this embodiment includes the lighting device 1 of any one of the first to eighth embodiments, the same effects as described above can be achieved, and the deviation of the ratio of the solid state light emitting element groups Lr and Lg from the target output ratio is reduced. Thus, the deviation duv of the mixed color light of the lights irradiated by the light emitting element groups L is reduced and the color reproducibility can be improved.

While the invention has been shown and described with respect to the embodiments, it will be understood by those skilled in the art that various changes and modification may be made without departing from the scope of the invention as defined in the following claims.

What is claimed is:

1. A lighting device comprising:

a plurality of lighting control units configured to control lighting of a plurality of solid state lighting element groups irradiating lights of different chromaticities; and a color ratio setting unit for setting a target output ratio of the solid state light emitting element groups, wherein the lighting control units are provided for the solid state light emitting element groups respectively, wherein, in an xy chromaticity diagram of an XYZ color system, a straight line connecting chromaticity coordinates of lights irradiated by a first and a second solid state light emitting element group among the solid state light emitting element groups intersects a black body locus, wherein the lighting control units include a first lighting control unit for controlling lighting of the first solid state light emitting element group and a second lighting control unit for controlling lighting of the second solid state light emitting element group, wherein the target output ratio includes a target output ratio of the second to the first solid state light emitting element group, and wherein the first and the second lighting control unit respectively perform feedback control whereby feedback control of the second lighting control unit is based at least in part on a detection result of feedback control of the first lighting control unit to cause an output ratio of the second to the first solid state light emitting element group to become equal to the target output ratio of the second to the first solid state light emitting element group.

2. The lighting device of claim 1, wherein the first lighting control unit includes:

a first drive circuit which supplies a power to the first solid state light emitting element group;

a first detection unit which detects the power being supplied from the first drive circuit to the first solid state light emitting element group; and a first control circuit which performs a feedback-control on the first drive circuit such that a detection result of the first detection unit becomes equal to a first reference value, and wherein the second lighting control unit includes:

a second drive circuit which supplies a power to the second solid state light emitting element group;

a second detection unit which detects the power being supplied from the second drive circuit to the second solid state light emitting element group; and a second control circuit which performs a feedback-control on the second drive circuit such that a detection result of the second detection unit becomes equal to a second reference value obtained based on the detection result of the first detection unit.

3. The lighting device of claim 2, further comprising an output control unit configured to vary the first reference value.

4. The lighting device of claim 2, wherein the first and the second drive circuit respectively supply to the first and the second solid state light emitting element group a first and a second intermittent current having a first and a second ON period respectively set based on the target output ratio of the second to the first solid state light emitting element group, wherein the first detection unit detects an amplitude of the first intermittent current in the first ON period and the second detection unit detects an amplitude of the second intermittent current in the second ON period, wherein the first control circuit performs a feedback control such that the amplitude of the first intermittent current becomes equal to the first reference value, and wherein the second control circuit performs a feedback control such that the amplitude of the second intermittent current becomes equal to the amplitude of the first intermittent current.

5. The lighting device of claim 2, wherein the second reference value is generated by multiplying the target output ratio of the second to the first solid state light emitting element group by the detection result of the first detection unit.

6. The lighting device of claim 2, further comprising an error calculating unit which calculates an amplified difference between the detection result of the first detection unit and the first reference value with respect to a total output from the first and the second solid state light emitting element group, wherein the second reference value is generated by multiplying a ratio of an output from the second solid state light emitting element group to a total output from the first and the second solid state light emitting element group by a calculation result of the error calculating unit, and adding the multiplication result and a third reference value obtained based on the target output ratio of the second to the first solid state light emitting element group.

7. The lighting device of claim 1, wherein the first lighting control unit includes a first drive circuit which supplies a power to the first solid state light emitting element group; a first detection unit which detects the power being supplied from the first drive circuit to the first solid state light emitting element group; and a first control circuit which performs a feedback-control on the first drive circuit, and wherein the second lighting control unit includes a second drive circuit which supplies a power to the second solid state light emitting element group; a second detection unit which detects the power being supplied from the second drive circuit to the second solid state light emitting element group; and a second control circuit which performs a feedback-control on the second drive circuit, and the lighting device further comprising:

an adder which generates a total detection result by adding the detection results of the first and the second detection unit; and a dividing unit which generates a division detection result for each of the first and the second lighting control unit by dividing the total detection result in a predetermined ratio, and outputs the division detection result to each of the first and the second lighting control unit, wherein each of the first and the second control circuit performs a feedback control such that the division detection result outputted thereto becomes equal to a reference value set thereto.

8. The lighting device of claim 7, wherein the first and the second drive circuit respectively supply to the first and the second solid state light emitting element group a first and a second intermittent current having a first and a second ON period respectively set based on the target output ratio of the second to the first solid state light emitting element group, wherein the first detection unit detects an amplitude of the first intermittent current in the first ON period, and the second detection unit detects an amplitude of the second intermittent current in the second ON period, wherein the adder generates the total detection result by adding the amplitude of the first intermittent current and the amplitude of the second intermittent current, and wherein the dividing unit generates the division detection result by equally dividing the total detection result.

9. The lighting device of claim 7, wherein the dividing unit generates the division detection result for each of the first and the second lighting control unit by dividing the total detection result based on the target output ratio of the second to the first solid state light emitting element group, and outputs the division detection result for each of the first and the second lighting control unit to the corresponding lighting control unit.

10. An illumination apparatus comprising:

the lighting device described in claim 1;

solid state light emitting element groups which are turned on by the lighting device; and an apparatus main body accommodating the lighting device, the solid state light emitting element groups being mounted on the apparatus main body.

11. A lighting device comprising:

a first lighting control unit and one or more second lighting control units provided to respectively control a first solid state light emitting element group and one or more second solid state light emitting element groups irradiating lights of different chromaticities, wherein the first lighting control unit includes:

a first drive circuit which supplies a power to the first solid state light emitting element group;

a first detection unit which detects the power being supplied from the first drive circuit to the first solid state light emitting element group; and a first control circuit which performs a feedback-control on the first drive circuit such that a detection result of the first detection unit becomes equal to a first reference value, and wherein each of the second lighting control units includes:

a second drive circuit which supplies a power to the corresponding second solid state light emitting element group;

a second detection unit which detects the power being supplied from the second drive circuit to the corresponding second solid state light emitting element group; and a second control circuit which performs a feedback-control on the second drive circuit such that a detection result of the second detection unit becomes equal to a second reference value obtained based on the detection result of the first detection unit.

12. The lighting device of claim 11, further comprising an output control unit configured to vary the first reference value.

13. The lighting device of claim 11, further comprising a color ratio setting unit which sets a target output ratio of each of the second solid state light emitting element groups to the first solid state light emitting element group, wherein the first drive circuit and the second drive circuit respectively supply to the first solid state light emitting element group and the corresponding second solid state light emitting element group a first and a second intermittent current having a first and a second ON period respectively set based on the target output ratio of the corresponding second solid state light emitting element group to the first solid state light emitting element group, wherein the first detection unit detects an amplitude of the first intermittent current in the first ON period, and the second detection unit detects an amplitude of the second intermittent current in the second ON period, wherein the first control circuit performs a feedback control such that the amplitude of the first intermittent current becomes equal to the first reference value, and wherein the second control circuit performs a feedback control such that the amplitude of the second intermittent current becomes equal to the amplitude of the first intermittent current.

14. The lighting device of claim 11, further comprising a color ratio setting unit which sets a target output ratio of each of the second solid state light emitting element groups to the first solid state light emitting element group, wherein the second reference value is generated by multiplying the target output ratio of each of the second solid state light emitting element group to the first solid state light emitting element group by the detection result of the first detection unit.

15. The lighting device of claim 11, further comprising:

a color ratio setting unit which sets a target output ratio of each of the second solid state light emitting element groups to the first solid state light emitting element group; and an error calculating unit which calculates an amplified difference between the detection result of the first detection unit and the first reference value with respect to a total output from the first solid state light emitting element group and the second solid state light emitting element groups, wherein the second reference value is generated by multiplying a ratio of an output from each of the second solid state light emitting element groups to the total output from the first solid state light emitting element group and the second solid state light emitting element groups by a calculation result of the error calculating unit, and adding the multiplication result and a third reference value obtained based on the target output ratio of each of the second solid state light emitting element groups to the first solid state light emitting element group.

16. An illumination apparatus comprising:

the lighting device described in claim 11;

solid state light emitting element groups which are turned on by the lighting device; and an apparatus main body accommodating the lighting device, the solid state light emitting element groups being mounted on the apparatus main body.

* * * * *